United States Patent [19]

Sugahara et al.

[11] 4,069,295

[45] Jan. 17, 1978

[54] TREATING RAW MATERIALS CONTAINING TITANIUM COMPONENTS

[75] Inventors: Yujiro Sugahara, Tokyo; Yoshibumi Noshi, Tsuruoka; Hiroyuki Naito, Tsuruoka; Kiyoshi Takai, Tsuruoka; Noboru Maruyama, Tsuruoka, all of Japan

[73] Assignee: Mizusawa Kagaku Kogyo Kabushiki Kaisha, Osaka, Japan

[21] Appl. No.: 682,058

[22] Filed: Apr. 30, 1976

[30] Foreign Application Priority Data

May 1, 1975 Japan ..... 50-52071
Apr. 8, 1976 Japan ..... 51-38752

[51] Int. Cl.[2] ..... C01G 45/00; C01G 37/14; C01G 31/00; C01G 23/08

[52] U.S. Cl. ..... 423/49; 423/61; 423/68; 423/81; 423/84; 423/393; 75/24; 75/1 T; 75/257

[58] Field of Search ..... 423/49, 61, 62, 68, 423/81, 84, 593, 596, 599; 75/1, 24, 94, 121

[56] References Cited

U.S. PATENT DOCUMENTS

| | | | |
|---|---|---|---|
| 1,454,564 | 5/1923 | Ruff | 423/84 |
| 1,609,826 | 12/1926 | Kinzie | 423/84 |
| 2,256,536 | 9/1941 | Udy | 423/61 |
| 2,501,952 | 3/1950 | Maier | 423/596 |
| 3,137,541 | 6/1964 | Cooke | 423/596 |
| 3,447,894 | 6/1969 | Gustison et al. | 75/121 |
| 3,859,412 | 1/1975 | Okabe et al. | 423/61 |

*Primary Examiner*—O. R. Vertiz
*Assistant Examiner*—Brian E. Hearn
*Attorney, Agent, or Firm*—Sherman & Shalloway

[57] ABSTRACT

A method of treating raw materials containing components of metals of the group IVb of the Periodic Table, which comprises heat-treating a raw material of a component of a metal of the group IVb of the Periodic Table containing coloring poisonous metal components such as Mn, V and Cr components in the presence of a flux composed mainly of an alkali metal nitrate or an alkali metal peroxide which is a thermal decomposition product of the alkali metal nitrate in an amount 2 to 5 times the amount of the raw material on the weight basis in a non-reducing atmosphere to thereby effect fluxing reaction, and subjecting the resulting fluxing reaction product to a leaching treatment of at least one stage in an aqueous medium to separate the fluxing reaction product into said coloring metal components and a concentrate of the component of the group IVb of the Periodic Table which is acid-soluble and substantially free of said coloring poisonous metal components. In practising this treating method, if a residue left after the above leaching step is incorporated into a mixture of the raw material and the flux, the composition is granulated and the granulated composition is heat-treated, the fluxing reaction of the raw material can be accomplished while keeping the granulated composition in the substantially non-sticky granular state throughout the fluxing heat treatment.

9 Claims, 4 Drawing Figures

TREATING RAW MATERIALS CONTAINING TITANIUM COMPONENTS

This invention relates to a method of treating ores, slags and other raw materials containing components of metals of the group IVb of the Periodic Table.

More particularly, the invention relates to a method of treating ores, slags and other raw materials containing components of metals of the group IVb of the Periodic Table, especially titanium components, according to which all of the metal components contained in the raw material can be separated in valuable forms without discharging materials causing environmental pollution, such as waste waters and industrial wastes.

Moreover, the invention relates to a method of treating raw materials such as mentioned above, which comprises heat-treating a raw material containing a component of a metal of the group IVb of the Periodic Table in the presence of a flux and subjecting the heat-treated product to a leaching treatment with an aqueous medium to thereby separate a concentrate of the component of the metal of the group IVb of the Periodic Table. More specifically, the invention relates to such treatment method wherein the heat treatment of the raw material in the presence of a flux is carried out while maintaining the raw material in the form of a substantially non-sticky granule.

As known industrial methods for production of titanium oxide, there are mentioned a sulfuric acid method and a chlorine method. Each of these known industrial methods, however, involves various problems, for example, those of environmental pollution and shortage of resources. For example, although the sulfuric acid method is advantageous in that the kind of the starting titanium-containing material is not particularly limited and an ore having a titanium oxide content of 50 to 60% by weight, for instance, ilmenite, can be used as the starting material, the method involves a problem that large quantities of wastes are formed. More specifically, it is said that 3 to 4 tons of iron oxide hydrate and about 8 tons of dilute sulfuric acid are formed for producing 1 ton of titanium oxide. In view of prevention of environmental pollution, it is not permissible at all to discard wastes formed in such large quantities into rivers or seas. Further, if these wastes are treated again in a particular treatment plant to recover valuable resources, the manufacturing cost is inevitably increased. It is said that the manufacturing cost is increased by about 15% by this treatment of the wastes.

If the chlorine method is adopted for production of titanium oxide, although the problem of wastes is not brought about, the raw material to be used in the method is drastically limited and the practical operation involves various difficulties. For example, the raw material that can be used in this chlorine method is limited to a rutile ore having a titanium oxide content of at least 90% by weight. Because of shortage of such high purity titanium ore, the cost of the starting raw material is increased, resulting in increase of the manufacturing cost. According to this chlorine method, a high purity rutile ore such as mentioned above is reacted with chlorine gas to form titanium tetrachloride and the so formed titanium tetrachloride is reacted with oxygen to form titanium oxide and chlorine. Since these materials should be treated in the gaseous state at high temperatures and both the reactants and reaction products are highly corrosive, expensive materials should be used for equipments, and various operation conditions should be controlled severely.

Recently, various attempts have been made to prepare from low grade titanium ores high grade titanium concentrates. For example, the specification of British Pat. No. 1,338,969 discloses a method of preparing a metallic iron concentrate and a titanium concentrate from a titanium-iron ore which comprises forming a mixture of a titanium-iron ore such as ilmenite, a flux such as sodium chloride and a carbon material, heating the mixture at a temperature lower than the temperature forming a slag to form metallic iron by reduction of the titanium-iron ore and separating the so formed metallic iron from titanium oxide by physical means. This method is excellent in the point that metallic iron is separated from ilmenite directly by reduction without formation of by-products, but the method involves various problems. For example, impurity metal components contained in ilmenite, especially coloring poisonous metal components such as Mn, V and Cr components, are included in the titanium oxide concentrate, and therefore, these poisonous coloring metal components should inevitably be removed for preparing titanium oxide as the final product by some means or other, for example, according to the sulfuric acid method.

In addition, there have been proposed a method comprising incorporating a carbon material and a flux into a titanium-iron ore such as ilmenite, calcining and reducing the mixture and extracting impurities from the calcined and reduced product with a dilute acid (see, for example, Japanese Patent Publication No. 20688/74) and a method comprising adding silica and gypsum or the like to titanium oxide containing impurities, which is obtained by reduction and melting of ilmenite, oxidizing the mixture in the molten state and sieving the oxidized and molten product to separate a glass phase of impurities from a rutile phase (see, for example, Japanese Patent Application Laid-Open Specification No. 79400/74). These treatment methods are satisfactory in that a titanium-containing ore such as ilmenite can be concentrated into a purer form, but the purity of the titanium concentrate is still in an order of 95 to 97% by weight and it still contains considerable amounts of impurities. Accordingly, titanium oxide that can be applied to final uses cannot be obtained unless the concentrate is further treated according to the chlorine or sulfuric acid method. Moreover, coloring poisonous metal components such as Mn, V and Cr components, which are contained in the starting titanium-containing ore, are formed as by-products in the final stage, and therefore, various problems such as mentioned above are caused as regards disposal of these by-products as wastes.

As will be apparent from the foregoing, all of the conventional proposals for obtaining a titanium concentrate from a titanium-iron ore by using a flux or the like are insufficient in that titanium oxide cannot be separated and recovered in a high purity form, components of poisonous metals such as Mn, V and Cr cannot be recovered in valuable forms but merely as wastes and the flux used cannot be recovered in the form usable again for the treatment. Accordingly, these proposals are still unsatisfactory with respect to the concentrating effect and the manufacturing cost.

We noted that nitric acid can be recovered relatively easily if in the form of a vapor, various nitrates formed by reaction with nitric acid are generally decomposed at relatively low temperatures and $NO_x$ can be recovered with ease, and that the corrosive action of nitric acid is relatively low and no particularly severe condition is imposed on the material constituting the equipment, and we made research works on preparation of titanium dioxide from various titanium-containing materials by using nitric acid. However, it was found that the reactivity of nitric acid with titanium-containing materials such as ilmenite, sand iron slag and high titanium slag is generally low and use of nitric acid is unsatisfactory in the point that the starting titanium-containing material cannot be utilized effectively. For reference, reactivities of various mineral acids with various titanium-containing materials are shown in Table A given hereinafter. Experiments were conducted by adding a mineral acid to the starting titanium-containing material in an amount two times as large as the starting material on the weight basis and conducting the wet reaction in a ball mill at a temperature of 25° C.

Table A

| Starting Material | Mineral Acid (concentration, % by weight) | | | |
|---|---|---|---|---|
| | $HNO_3$(67.5) | $H_2SO_4$(67.5) | HCl(37) | HF(47) |
| Sand Iron Slag | 49.5 | 68.7 | 75.1 | — |
| Ilmenite | 2.3 | 2.1 | 48.6 | 87 |
| High Titanium Slag | 2.5 | 4.7 | 8.1 | 94.9 |

As will be apparent from the data shown in Table A, nitric acid shows a reaction ratio of about 50% even in the case of sand iron slag having a highest reactivity and it hardly reacts with ilmenite or high titanium slag. This tendency is observed not only in titanium-containing materials but also in zirconium-containing materials such as zircon sand.

In known methods for preparing titanium dioxide using either an acid or a flux, it is very difficult to remove selectively coloring poisonous metals such as Mn, Cr and V from the titanium-containing raw material. This fact results in various disadvantages. For example, components of these coloring poisonous metals always accompany the titanium component at an acid treatment step, a hydrolyzing treatment step, a washing step or the like and they are discharged in the form of a dilute waste water, and metal components such as Mn, V and Cr cannot be recovered in industrially valuable forms. Further, since these metals are not recovered in industrially valuable forms, they cannot but be discarded in the form of waste waters or industrial wastes and hence, a problem of environmental pollution is inevitably caused.

We furthered our research works and found that when a raw material containing a metal of the group IVb of the Periodic Table, for example, a titanium-containing raw material such as ilmenite, sand iron slag, high titanium slag and rutile ore is mixed with a flux composed mainly of an alkali nitrate or a thermal decomposition product thereof, i.e., an alkali peroxide and the mixture is heat-treated, the fluxing operation of the raw material containing a metal of the group IVb of the Periodic Table can be performed very easily, components of coloring poisonous metals contained in the resulting heat-treated product, such as Mn, V and Cr, can easily be dissolved out selectively into an aqueous medium, and these poisonous metal components can be isolated in industrially valuable forms and an acid-soluble concentrate of the component of the metal of the group IVb of the Periodic Table can be obtained as a leaching residue substantially free of the coloring poisonous metal components.

We also found that when, in conducting the above fluxing heat treatment, if a mixture of the above starting raw material, a flux in an amount 2 to 5 times as large as the starting raw material on the weight basis and the above-mentioned leaching residue in an amount at least 1.2 times as large as the starting raw material on the weight basis is molded into granules and the resulting granular composition is heat-treated, the fluxing heat treatment can be accomplished very effectively while maintaining the composition in the substantially non-sticky state.

According to this invention, there can be attained various novel and prominent advantages by the combination of the above-mentioned specific heat treatment and the leaching treatment with an aqueous medium.

More specifically, components of coloring poisonous metals such as Mn, V and Cr can be isolated in pure and industrially valuable forms from the aqueous leaching solution, and these metal components can be advantageously applied to known uses and discharge of these poisonous metal components into natural environments as industrial wastes can be prevented.

Further, the concentrate obtained by the abovementioned fluxing and leaching treatments is recovered in a leaching residue substantially free of poisonous coloring metals such as Mn, V and Cr, and since this concentrate is soluble in an inorganic acid such as nitric acid, sulfuric acid or the like or an organic acid, a component of the metal of the group IVb of the Periodic Table contained in the concentrate or an accompanying metal component can easily be separated by means known per se, and a product of a component of the metal of the group IVb of the Periodic Table, such as titanium oxide, which has thus been isolated from the concentrate, is excellent in physical properties such as whiteness.

As will be apparent from the foregoing illustration, according to the method of this invention, components of metals of the group IVb of the Periodic Table such as titanium and zirconium can be recovered with ease in highly pure forms from raw materials containing metals of the group IVb of the Periodic Table, such as titanium- or zirconium-containing ores, and furthermore, all the metal components contained in these raw materials can be separated and recovered in pure and industrially valuable forms and therefore, environmental pollution by industrial wastes is no caused at all.

Still further, according to the method of this invention, since an alkali nitrate or a decomposition product thereof, i.e., an alkali peroxide, is used as a flux, $NO_x$ gas is generated in the heat treatment, and this $NO_x$ gas can be recovered as nitric acid or an alkali nitrate and the former may be used for the leaching treatment or the treatment of the residual concentrate and the latter can be used repeatedly as a flux. Still further, the alkali metal component contained in the heat-treated product can be recovered as a flux at the subsequent step of the leaching treatment or the treatment of the residual concentrate, and it can be used again effectively. Thus, according to the present invention, raw materials of components of metals of the group IVb of the Periodic Table can be consistently treated with economical advantages without causing environmental pollution.

According to this invention, if prior to the heat treatment of a raw material containing a component of a metal of the group IVb of the Periodic Table (hereinafter referred to merely as "raw material") in the presence of a flux composed mainly of an alkali nitrate or an alkali peroxide which is a thermal decomposition product thereof (hereinafter referred to merely as "flux"), the above-mentioned residue left after he leaching treatment with an aqueous medium is incorporated in a mixture of the raw material and the flux and the resulting composition is molded into granules, the following various and prominent effects and advantages can be attained.

In the conventional fluxing treatment, a composition of a raw material and a flux should be treated in a melting furnace at high tempeatures for a long time, and hence, a large quantity of heat energy and an apparatus of a large scale are necessary. Further, a relatively large amount of a soda fume is generated by this high temperature treatment and a particular dust precipitator should be provided for removal of this fume. Furthermore, the product obtained by this fluxing treatment is a highly viscous liquid and it is ofen difficult to handle this liquid product in a continuous manner. Still in addition, since this fluxing treatment product is maintained at high temperatures and highly basic, it penetrates into the furnace-constituting material and corrodes it. A furnace-constituting material capable of resisting the highly corrosive action of this fluxing treatment product is hardly available, and if available, such material is very expensive and use of such material results in industrial disadvantages.

In contrast, according to the treatment of this invention, granules of the above composition comprising the starting raw material, flux and leaching residue can be maintained in a substantially non-sticky granular form throughout the step of the reaction between the raw material and the flux, and therefore, the fluxing treatment can be acomplished at a relatively low temperature for a relatively short time, for example, several minutes to scores of minutes, while preventing occurrence of such troubles as generation of soda fumes. Moreover, the product obtained by this fluxing treatment can easily be withdrawn and transported for the subsequent steps, making a continuous operation possible. Still in addition, an ordinary commercially available refractory material can be used for construction of a furnace for the heat treatment and such troubles as corrosion of the treating furnace can be effectively prevented.

When an oxide, hydroxide or nitrate of an alkaline earth metal is incorporated into the raw material together with the flux in an amount of 20 to 50% by weight based on the flux and the resulting composition is subjected to the heat treatment, the fluxing reaction product is obtained in the form of a granule having a relatively low stickiness. In this case, however, since a relatively large amount of the alkaline metal component is contained in the fluxing reaction product, when the component of a metal of the group IVb of the Periodic Table is isolated from the concentrate by leaching with nitro or the like, a very large amount of the leaching acid is necessary, and an alkaline earth metal nitrate or the like is formed in a large quantity as a by-product and disposal of this salt is troublesome.

In accordance with a preferred embodiment of this invention, since a residue left after leaching of the metal component with an aqueous medium is used as a granulating assistant and incorporation into a mixture of the raw material and the flux, the resulting composition can be subjected to the fluxing heat treatment while maintaining the non-sticky granular state, and the amount of the acid used for separation of the metal component can be reduced and a trouble of disposal of large quantities of salts can be eliminated at this step of separation of the metal component.

This invention will now be described in detail.

RAW MATERIAL

In the instant specification and claims, by the term "a metal of the group IVb of the Periodic Table" is meant a metal belonging to the group IVb of the Periodic Table described on page 115 of Ryutaro Tsuchida, "Introduction to Chemistry" (1941), and the group IVb includes titanium zirconium, hafnium and thorium.

Any of ilmenite, sand iron slag, high titanium slag and rutile ore can be used as the titanium raw material. They may be used singly or in the form of a mixture of two or more of them. For reference, oxide compositions of these titanium raw materials are shown in Table B.

Table B

| Ore | Main Component | Content (% by weight) |
|---|---|---|
| Ilmenite | $TiO_2$ | 40 - 60 |
| | $FeO$ | 9 - 40 |
| | $Fe_2O_3$ | 7 - 25 |
| | $SiO_2$ | 1 - 2 |
| | $Al_2O_3$ | 0.5 - 5 |
| | $V_2O_3$ | 0.05 - 0.5 |
| | $CrO_3$ | 0.01 - 0.1 |
| | $MnO$ | 0.5 - 3 |
| Sand Iron Slag | $TiO_2$ | 20 - 35 |
| | $SiO_2$ | 20 - 25 |
| | $CaO$ | 20 - 25 |
| | $Al_2O_3$ | 6 - 13 |
| | $Fe_2O_3$ | 2 - 6 |
| | $V_2O_5$ | 0.1 - 2 |
| | $MnO$ | 0.5 - 2 |
| | $Cr_2O_3$ | 0.01 - 0.2 |
| High Titanium Slag | $TiO_2$ | 70 - 90 |
| | $FeO$ | 7 - 10 |
| | $SiO_2$ | 2.5 - 4 |
| | $Al_2O_3$ | 1 - 5 |
| | $CaO$ | 0.05 - 0.5 |
| | $V_2O_5$ | 0.1 - 0.7 |
| | $Cr_2O_3$ | 0.01 - 0.3 |
| | $MnO$ | 0.5 - 3 |
| Rutile Ore | $TiO_2$ | 94 - 98 |
| | $Fe_2O_3$ | 0.5 - 2 |
| | $SiO_2$ | 1 - 2 |
| | $V_2O_5$, $Cr_2O_3$, $MnO$ | trace |

These titanium raw materials contain, in addition to the titanium component, other components such as iron, silicic acid, calcium, magnesium and aluminum components, and they further contain inevitably traces or small amounts of poisonous coloring metal components such as V, Mn, Co, and Cr components and the presence of these metal components cannot be neglected. According to the method of this invention, raw materials containing these poisonous coloring metal components, especially V, Mn and Co components, at relatively high contents can be advantageously treated.

As the zirconium raw material, there can be used concentrates of zircon sand ( composed mainly of $ZrO_2$ and $SiO_2$), baddeleyite ( composed mainly of $ZrO_2$) and other zirconium ores.

As the thorium raw material, there can be used concentrates of monazite, thorite, thorianite and the like.

Of course, ores containing components of metals of the group IVb of the Periodic Table may be pulverized according to the dry or wet method and refined by known means such as water sieving, air sieving, electrophoresis, and decantation or by water washing, acid washing, alkali washing or organic solvent washing, prior to the heat treatment of this invention described in detail hereinafter.

FLUX

One of the important features of this invention resides in the finding that when a flux composed mainly of an alkali nitrate or a thermal decomposition product thereof, i.e., an alkali peroxide is used for the heat treatment of the raw material, coloring poisonous metal components such as Mn, Cr and V components in the resulting heat-treated product can easily be dissolved out in an aqueous medium and the residual concentrate containing components of metals of the group IVb of the Periodic Table is soluble in an acid.

Sodium nitrate is preferably used as the alkali nitrate, but other alkali metal nitrates such as potassium nitrate can be similarly used. These alkali nitrates may be used singly or in combination with other fluxes. As such fluxes that can be used in combination with the alkali nitrate, there can be mentioned, for example, oxides, hydroxides, carbonates, nitrites, halides, halogen oxyacid salts, oxalates and formates of alkali metals such as sodium and alkaline earth metals such as calcium and magnesium. In order to recover nitrogen oxides in a relatively pure from, it is preferred to use an oxide, peroxide or hydroxide of an alkali metal or alkaline earth metal. In case the alkali nitrate is used in combination with other flux, it is preferred that the amount of other flux be up to 50% by weight ( in the instant specification, "%" and "parts" are by weight unless otherwise indicated ), especially up to 30%, based on the alkali nitrate.

It is important that the flux should be in corporated in the raw material in an amount 2 to 5 times ( on the weight basis ), preferably 3 to 4 times, the amount of the raw material. When the amount of the flux is smaller than 2 times the amount of the raw material, it is difficult to improve conspicuously the reactivity of nitric acid, as illustrated in Example 1 given hereinafter. If the flux is used in such a large amount as exceeding 5 times the amount of the raw material, no particular advantage can be attained by the increase of the amount of the flux but economical disadvantages are brought about. In the actual operation, the amount of the flux is selected within the above range so that various components contained in the starting raw material can e effectively recovered. For example, if chromium or vanadium components are contained in relatively large amounts in the raw material, it is preferred that a relatively large amount be selected within the above range as the amount of the flux.

In this invention, the particle size of the flux to be used is not particularly critical, but it is generally preferred to use a flux in which particles having a particle size of 0.1 to 2 mm occupy at least 30%, especially at least 70%, of the total particles.

Mixing and Granulation

Another important feature of this invention resides in the novel finding that when the leaching residue is incorporated into the above-mentioned raw material together with the flux and the resulting composition is granulated prior to the heat treatment, the heat treatment can be accomplished while keeping the granular state.

The leaching residue that is used in this invention is one obtained by heating the raw material and the flux, optionally with the leaching residue according to this invention and subjecting the heat treatment product to a leaching treatment with an aqueous medium to remove therefrom coloring poisonous metal components such as Mn, Cr and V components. More specifically, when a heat-treated product (A) of the raw material and the flux is incorporated in the raw material and the flux and the resulting composition is granulated and heat-treated, it is observed that the composition is converted to a relatively highly viscous melt or liquid during the heat treatment. On the other hand, when the above heat-treated product (A) is subjected to a leaching treatment with an aqueous medium and the leaching residue (B) is incorporated in the raw material and the flux and the resulting composition is granulated and heat-treated, the heat treatment can be accomplished while the composition is kept in the non-sticky granular state.

In this invention, the reason why the granular state can be retained during the heat treatment if the leaching residue (B) is incorporated into the raw material and the flux has not been completely elucidated, but it is believed that different from the heat-treated product (A), the leaching residue (B) is infusible at the heat treatment temperature and it is inactive to the flux contained in the granulated composition. This will be agreed from the fact that 10 to 30% of the alkali metal component in the flux used is contained in this leaching residue (B) and the components of metals of the group IVb of the Periodic Table are present in the leaching residue in the state different from the presence state in the heat-treated product (A) or the starting raw material.

It is important that the leaching residue used should have such a property that it can retain therein the flux or the fusing reaction product between the raw material and the flux, that is in the molten or fused state, during the heat treatment. In view of the foregoing, it is preferred that the oil absorption of the leaching residue be as high as possible, for example, at least 30 cc/100 g, especially at least 40 cc/100 g. Further, it is preferred that the particle size of the leaching residue be as small as possible, in general, smaller than 124 $\mu$ as the average particle size, especially smaller than 89 $\mu$ as the average particle size. The oil absorption was determined according to the method of JIS K-5101. More specifically, 2 g of the sample was placed on a glass sheet and boiled linseed oil was added dropwise onto the sample. The entire mixture was sufficiently kneaded by a spatula until the entire system become a putty-like consistent solid. The amount required for forming this putty-like consistent solid was measured, and the oil absorption was expressed by this amount of the oil (cc/100 g).

In order to maintain a non-sticky granular state in the starting composition during all the stages of the heat treatment, it is important that the leaching residue should be used in an amount of at least 1.2 times (on the weight basis), especially at least 1.3 times, the amount of the raw material. In view of the heat economy, it is disadvantageous to use the leaching residue in too large an amount. Accordingly, it is generally preferred that the leaching residue be used in an amount of up to 2.0 times, especially up to 1.7 times, the amount of the raw material.

Mixing and granulation of the raw material, the flux and the leaching residue may be performed according to the dry or wet method. For example, the respective components are blended by using a known dry blender or mixer and the mixture is granulated by a tablet machine or the like. Further, the respective components are blended according to the wet method, water or the like is added as the granulation medium, and the resulting liquid composition is granulated according to known means such as extrusion granulation, rotary granulation, spray-dry granulation and mixing granulation methods. In general, it is preferred that granulation be conducted by using a granulation medium such as water. In this case, especially good results are obtained when the liquid granulation medium is used in an amount 0.05 to 0.5 times (on the weight basis), especially 0.1 to 0.25 times, the amount of the raw material. When the amount or quality of the liquid granulation medium is such that all of the flux is dissolved, the flux is precipitated and deposited on the surface of the granulated product at the drying step and it often becomes difficult to perform the heat treatment while retaining the non-sticky granular state. In view of the foregoing, when water is used as the liquid granulation medium, it is especially preferred that the amount of water be up to 0.2 time the amount of the raw material. The so obtained granulation product is dried according to need and it is subjected to the heat treatment.

The size of the granulation product is not particular critical in this invention, and in general, the size is selected within the range of 0.1 to 30 mm, especially 0.2 to 20 mm.

In order to advance the fusing reaction in a relatively short time even in the interior of the granulation product uniformly, however, it is preferred that the size of the granulation product be relatively small, for example, up to 15 mm.

This granulation product may have an optional form, for example, a spherical, sand-like, tablet-like, columnar, cubic or granular form according to the granulation method adopted. When the granulation product is heat-treated in a continuous manner, in view of the handling easiness, it is preferred that the form of the granulation product be spherical or substantially spherical.

In this invention, an oxide, hydroxide or nitrate of an alkaline earth metal can be used as the granulation assistant instead of the above-mentioned leaching residue. Also in this case, the fluxing reaction product obtained by heat-treating the raw material and the flux is retained in a granular state having a reduced stickiness. Accordingly, the heat treatment for the fluxing reaction can be performed in a continuous manner, and sticking of the reaction product to the wall of the melting furnace can be prevented and the problem of corrosion of the furnace material can be effectively solved. The reason why such advantages can be attained by the use of the above alkaline earth metal compounds has not been completely elucidated, but in view of the fact that the melting point of a mixture of an alkaline earth metal hydroxide or the like and the starting ore or slag is relatively high, namely 900° to 1000° C., while the melting temperature of a mixture of an alkali nitrate and the starting ore or slag is relatively low, namely 700° to 750° C., it is believed that the alkaline earth metal oxide or the like will probably act as the sticking-preventing agent for the fluxing reaction product formed by the heat treatment as well as the above-mentioned leaching residue. The alkaline earth metal compound may be mixed into the raw material according to the method mentioned hereinbefore with respect to the leaching residue. In general, it is preferred that the oxide, hydroxide or nitrate of an alkaline earth metal be used in an amount of 20 to 50%, especially 25 to 30%, based on the alkali nitrate as the flux.

Generally speaking, from the economical viewpoint, it is preferred that leaching residue be used as the granulation assistant.

HEAT TREATMENT (FLUXING REACTION)

A mixture of the above-mentioned raw material and flux optionally further containing a granulation assistant such as the above-mentioned leaching residue or alkaline earth metal compound is heat-treated at a temperature of 750° to 950° C., especially 850° to 950° C., to effect the fluxing reaction. When the temperature is lower than 750° C., it is difficult to convert all the components contained in the starting ore or slag to such reaction products as will be completely leached out by an aqueous medium or an aqueous solution of nitric acid. When the temperature is higher than 950° C., no particular improvement of the effect of the above conversion can be attained, but such disadvantages as corrosion of the furnace material and increase of power or heat consumption are rather brought about.

The heat treatment time is changed depending on the treatment temperature, the composition of the starting mixture and other factors. In general, the treatment time is selected within the range of 3 minutes to 2 hours, especially 5 minutes to 1 hour, so that the raw metal-containing material is completely fluxed by the heat treatment.

In order to recover nitrogen oxides formed by the reaction, it is important that the heat treatment should be conducted in a non-reducing atmosphere. For example, the heat treatment is preferably conducted in air, a nitrogen oxide atmosphere or a calcination exhaust gas atmosphere.

The heat treatment may be carried out in one stage or in a multi-staged manner. For example, it is possible to adopt a method in which a mixture containing the starting ore or slag, the flux and the like is preliminarily heated at a temperature of 300° to 500° C. to melt the flux and then, the mixture is finally heated at the above-mentioned temperature to flux the raw material. In case a sticking-preventing agent such as an alkaline earth metal hydroxide is used in combination with the alkali nitrate as the flux, it is possible to adopt a method in which the starting mixture is first heated at a temperature of 300° to 600° C. to prepare a granular mixture and then, the mixture is heated at a temperature of 750° to 950° C. while keeping it in the granular state to effect the fluxing reaction.

This heat treatment may be conducted batchwise or in a continuous manner, and various melting furnaces, for example, a reflection furnace, an open-hearth furnace, a revolving furnace, a retort and a moving layer type melting furnace, can be used for this heat treatment.

According to the preferred embodiment of this invention, since the heat treatment for the fluxing reaction can be performed while keeping the raw material mixture in a substantially non-sticky granular state, the heat treatment can be conducted batchwise or in a continuous manner by using a calcination furnace of the fixed bed, moving bed or fluidized bed type. For example, the heat treatment can be performed batchwise by using an extrusion furnace, a tunnel furnace, a retort furnace, a muffle furnace, a radiation furnace or a packed column type furnace, and the heat treatment can be conducted in a continuous manner by using a rotary kiln, a fluidized bed type calcination furnace, a moving bed type calcination furnace or a tunnel type calcination furnace.

In each case, such operations as withdrawal of the fluxing reaction product can easily be performed and troubles such as corrosion of the furnace material can be eliminated effectively.

When the leaching residue is used as the granulation assistant, it may be considered that the heat treatment for the fluxing reaction will be accomplished according to a method comprising heating a starting composition of the raw material, the flux and the leaching residue at a temperature of 300° to 600° C. to melt the flux alone and form a granular mixture and heating the mixture at a temperature of 750° to 950° C. According to this two-staged heat-treating method, however, a muddy liquid product is often formed at the final stage and it is difficult to perform the fluxing reaction in the granular state.

In this invention, according to the above heat treatment, coloring poisonous metal components such as Mn, V and Cr components contained in the raw material are converted to forms soluble in an aqueous medium and components of metals of the group IVb of the Periodic Table and all of other metal components are converted to acid-soluble forms.

LEACHING TREATMENT WITH AQUEOUS MEDIUM

According to this invention, the so obtained heat-treated product, namely the fluxing reaction product, is subjected to a leaching treatment of at least one stage using an aqueous medium. By this leaching treatment, coloring poisonous metal components such as Mn, V and Cr components are dissolved out into the aqueous medium substantially completely. For this leaching treatment, it is possible to adopt a method comprising performing the leaching treatment in one stage to dissolve out at a time coloring poisonous metal components such as Mn, V and Cr components into the aqueous medium and isolating the coloring poisonous metal components from the aqueous extract by means known per se. Alternately, there can be adopted a method comprising performing the leaching treatment in multi-stages by using several aqueous media differing in the pH and/or temperature conditions and dissolving out and isolating the coloring poisonous metal components one by one.

As pointed out hereinbefore, an alkali nitrate or a decomposition product thereof is used as the flux in this invention. This flux is very basic and when it is dispersed in water at a concentration of, for example, 40 to 50%, the dispersion has, in general, such a high pH value as 13 or more. In this invention, it is preferred that the leaching treatment be conducted so that the pH is higher than 3 at the final stage of the leaching treatment. If the pH is lower than 3 at the final stage of the leaching treatment, there is observed a tendency that components of metals of group IVb of the Periodic Table in the residue are dissolved out and coloring poisonous metal components such as Mn, V and Cr components are left in the residue, and it becomes difficult to separate completely the components of metals of group IVb of the Periodic Table and the coloring poisonous metal components such as Mn, V and Cr components from the starting ore or slag. In this invention, it is preferred to separate the respective poisonous metal components one by one independently by changing the temperature and pH of the aqueous medium at the leaching treatment.

For example, the manganese component contained in the fluxing reaction product can be dissolved out substantially completely if the leaching treatment is carried out by using cold water maintained at 4° to 30° C. In this cold water leaching treatment, the pH is generally maintained at a level higher than 13.5.

Vanadium and chromium components contained in the fluxing reaction product are dissolved out substantially completely by the leaching treatment using an aqueous medium having a pH of 3 to 13. In this case, in order to maintain the pH at 3 to 13 at the leaching step, it is preferred to add an acid such as nitric acid to the aqueous medium in advance.

In the above leaching treatment, some or considerable parts of alkali metal, aluminum and silicic acid components contained in the fluxing reaction product are also dissolved out into the aqueous medium. Accordingly, in order to recover all the metal components contained in the solution obtained by the leaching treatment, it is preferred to adopt the following recovery procedures.

The solution obtained by subjecting the fluxing reaction product to the cold water leaching treatment is subjected to an oxidation treatment at a temperature of, for example, 20° to 110° C. and the manganese component is first separated in the form of a precipitate of a hydrous oxide ( $MnO.xH_2O$ ). For this oxidation treatment, a peroxide such as hydrogen peroxide ( $H_2O_2$ ), ozone or molecular oxygen can be used. For example, separation and recovery of the manganese component can be conducted industrially very easily by subjecting the solution to aeration.

Then, the residue left after the cold water leaching treatment is subjected to a leaching treatment using warm or hot water maintained at 60° to 110° C. The water-soluble silicic acid component and aluminum component (exclusive of a strong acid-soluble component described below) are easily dissolved out in the aqueous medium by the above cold water leaching treatment and this warm water leaching treatment. Accordingly, when an acid such as nitric acid or a liquid mixture of nitric acid and an alkali nitrate is added to the mother liquor left after removal of the precipitate of the manganese component and the aqueous medium obtained by the warm water leaching treatment to adjust the pH of the mixture to 5 to 9, the silicic acid component and aluminum hydroxide can be recovered as precipitates.

The residue left after the above warm water leaching treatment is subjected to a leaching treatment with an aqueous medium under such conditions that the pH is maintained at 3 to 12 during the leaching treatment. The solution obtained by this leaching treatment is combined with the mother liquor left after separation of the precipitates of the silicic acid component and the alumina component and the mixture is concentrated directly or after the pH has been adjusted to 2 to 5, whereby the alkali metal component can be separated in the form of, for example, a crystal of an alkali nitrate. The solution left after separation of the alkali nitrate crystal is treated with an oxidant such as hydrogen peroxide and with ammonium hydroxide, after the pH has been adjusted to 0 to 1.5 if necessary, whereby the contained vanadium component is recovered and separated as ammonium vanadate. From the remaining chromium-containing concentrate, the chromium component is separated and recovered in the form of chromic anhydride ($Cr_2O_3$), ammonium chromate or alkali chromate by known means.

In the method of this invention, the leaching treatment of the fluxing reaction product may be conducted batchwise or in a continuous manner. For example, the muddy molten reaction product or granular reaction product withdrawn from the melting furnace is cooled rapidly with an aqueous medium and it is then subjected to the leaching treatment while it is wet-pulverized by using a ball mill or the like. Alternately, the leaching treatment can be accomplished by packing the powdery or granular fluxing reaction product in an extraction apparatus of the fixed bed, moving bed or fluidized bed type and contacting it with an aqueous medium while changing extraction conditions. Furhermore, the leaching treatment may be accomplished by feeding the fluxing reaction product from one end of an inclined tube having a spiral passage formed in the interior thereof, feeding water from the other end and contacting them in a counter-current manner.

As will be apparent from the foregoing illustration, according to the method of this invention, by heat-treating a mixture of the raw material, a flux composed mainly of an alkali nitrate or a thermal decomposition product thereof, i.e., an alkali peroxide and, if desired, the leaching residue or other granulation assistant or sticking-preventing agent to effect the fluxing reaction and subjecting the fluxing reaction product to a leaching treatment using an aqueous medium, coloring poisonous metal components such as Mn, V and Cr components can be separated substantially completely in industrially valuable forms. The residue left after separation of these coloring poisonous metal component is present in an acid-soluble.

As pointed out hereinbefore by reference to Table A, it is quite difficult to dissolve titanium-containing raw materials such as sand iron slag, ilmenite and high titanium slag completely in mineral acids such as sulfuric acid, nitric acid and hydrochloric acid. It is substantially impossible to dissolve these starting materials by using nitric acid. According to this invention, by subjecting these titanium-containing raw materials to the specific heat treatment and the specific leaching treatment, it is made possible to dissolve valuable components contained in these raw materials completely in various mineral acids and form solutions substantially free of coloring poisonous metal components such as Mn, Cr and V components.

CONCENTRATES OF COMPONENTS OF METALS OF GROUP IVb OF PERIODIC TABLE

After the above leaching treatment, a residue substantially free of coloring poisonous metal components such as Mn, V and Cr components and containing components of metals of the group IVb of the Periodic Table is obtained. According to this invention, a part or all of this residue is used for recovery of the components of metals of the group IVb of the Periodic Table. According to the above-mentioned preferred embodiment of this invention, a part of the residue is recycled to the step of preparing a granular composition to be subjected to the fluxing heat treatment. The amount of the residue obtained after the fluxing heat treatment and the leaching treatment using an aqueous medium differs considerably depending on the raw material used, but in general, the amount of the residue (exclusive of the residue added at the step of granulation of the starting composition) is 1.2 to 1.5 times (on the weight basis) the amount used of the raw material. More specifically, in the case of ilmenite, the amount of the residue is 1.2 to 1.5 times the amount used of the raw material and in the case of sand iron slag, the amount of the residue is 1.3 to 1.5 times the amount used of the raw material. In the case of high titanium slag, the amount of the residue is 1.3 to 1.5 times the amount used of the raw material. Accordingly, when the method is worked constantly on an industrial scale, the above-mentioned amount of the residue is subjected to an extraction treatment using an acid, which will be detailed hereinafter.

This residue is dissolved in a mineral acid such as nitric acid, hydrochloric acid, sulfuric acid or the like substantially completely under mild conditions, for example, at room temperature. For example, when the residue is treated with 10 to 67 % nitric acid at a temperature of 10° to 50° C., it is completely dissolved, and similarly, the residue is completely dissolved in hydrochloric acid and sulfuric acid under mild conditions.

In this invention, since the residue left after removal of coloring poisonous metal components such as Mn, V and Cr components is completely soluble in mineral acids such as sulfuric acid, hydrochloric acid and nitric acid and organic acids such as oxalic acid, acetic acid and tartaric acid, components of metals of the group IVb of the Periodic Table can be separated and recovered in pure forms in high yields by means known per se. The residue left after the above leaching treatment, namely a concentrate of a metal of the group IVb of the Periodic Table, contains, in addition to this metal component, considerable amounts of iron, alkaline earth metal and silica components, though the composition of this concentrate is varied to some extent depending on the kind of the raw material used. Separation of the component of a metal of the group IVb of the Periodic Table from copresent metals and further silica components can be performed by means known per se, for example, the hydrolyzing method or phosphoric acid method, after the silica component has been removed by gelation if desired. More specifically, the component of the metal of the group IVb of the Periodic Table is recovered by separating the metal component in the form of a precipitate from an acid solution formed by dissolution of the residue.

For example, the concentrate of the component of the metal IVb of the Periodic Table left after the leaching treatment is dissolved in an acid such as sulfuric acid, the resulting sulfuric acid solution is heated to effect hydrolysis and the above procedures are repeated according to need, whereby the metal component can be separated in the form of a relatively pure hydrous oxide. At this treatment, since the silica component contained in the concentrate, namely the residue left after the leaching treatment, is gelled when the concentrate is dissolved in an acid, the gelled silica component can easily be removed by filtration or the like. Since the iron and alkaline earth metal components are contained in the mother liquor left after the hydrolysis treatment, the iron and alkaline earth metal components are recovered from this mother liquor. When the hydrous oxide of the metal of the group IVb of the Periodic Table is formed by hydrolysis, coprecipitation of the iron component in the hydrous oxide takes place. In order to prevent this coprecipitation of the iron component, it is possible to conduct the hydrolysis at a temperature of at least 150° C. or under a pressure of 5 to 15 atmospheres (gauge) according to the known technique. Further, in order to maintain the acid concentration at a certain level constantly, it is possible to perform heating under refluxing conditions.

Further, it is possible to adopt a method in which the concentrate of the metal of the group IVb of the Periodic Table is dissolved in an acid such as sulfuric acid, the silicic acid component is separated by gelation according to need, and an oxyacid or phophorus is added to the solution in an amount of $\frac{1}{3}$ to 1 mole (as the oxide) per mole (as the oxide) of the component of the metal of the group IVb of the Periodic Table, whereby the metal of the group IVb of the Periodic Table can be selectively separated as a precipitate of a salt of the phophorus oxyacid.

One of industrial advantages of this invention is that the concentrate of the component of a metal of the group IVb of the Periodic Table left after removal of coloring poisonous metal components such as Mn, Cr and V components can be obtained in a form easily soluble in nitric acid. When an acid such as sulfuric acid is used for separation and purification of a component of a metal of the group IVb of the Periodic Table, for example, titanium oxide, large quantities of dilute waste acids, alkaline earth metal salts such as gypsum and iron salts such as sulfuric acid salts of iron are formed as by-products, and it is very difficult to recover the acid from these by-products or even if the acid be recovered, the recovery cost is tremendous. In contrast, if it is permissible to use nitric acid instead of sulfuric acid or the like, nitric acid can easily be recovered from dilute waste acids by distillation or other simple means, and nitric acid salts formed as by-products, such as iron nitrates, calcium nitrate, magnesium nitrate and aluminum nitrate, can readily be decomposed to the respective metal oxides and nitrogen oxides ($NO_x$), and the thus formed $NO_x$ gases can be recovered as nitric acid or an alkali nitrate and can be recycled and used repeatedly. Accordingly, when the residue left after removal of coloring poisonous metal components such as Mn, Cr and V components is treated with nitric acid to separate the component of a metal of the group IVb of the Periodic Table from the copresent metal components, it is made possible to recycle the nitric acid and alkali metal components completely and use them repeatedly, and an integral consistent operation advantageous in prevention of environmental pollution and in reduction of the treatment cost becomes possible.

Of course, since the concentrate of the component of a metal of the group IVb of the Periodic Table left after removal of coloring poisonous metal components such as Mn, V and Cr components is substantially free of these poisonous metal components and is highly pure, it can be used as a raw material for preparing titanium tetrachloride or titanium oxide according to the so-called chlorine method.

As is apparent from the foregoing illustration, according to this invention, components of metals of the group IVb of the Periodic Table and other metal components contained in ores, slags and other raw materials can be isolated substantially completely in pure and valuable forms.

For example, phophorus oxyacid salts of metals of the group IVb of the Periodic Table isolated as titanium phosphate, zirconium phosphate and the like can be used as pigments, rust-preventive pigments, flame retardants, catalysts, curing agents and ion exchange members directly or after such post treatments as aging, water washing, drying and calcination. Hydrous oxides of metals of the group IVb of the Periodic Table isolated as hydroxides such as titanium hydroxide, when subjected to such post treatments as water washing, drying and calcination, can be applied in the form of titania, zirconia or thoria to production of white pigments, fillers, refractory materials and the like. Further, components of metals of the group IVb of the Periodic Table obtained in the form of solutions of nitrates can be advantageously used for the synthesis of various compounds of metals of the group IVb of the Periodic Table.

Other metal components isolated, for example, manganese oxide, ammonium vanadate, chromium oxide, iron hydroxide, calcium oxide, magnesium oxide, aluminum oxide and silicic acid can be advantageously applied to known uses because they are recovered in relatively pure forms.

RECOVERY OF NITROGEN OXIDES AND ALKALI METAL COMPONENTS

In the method of this invention, all of nitrogen oxides, dilute nitric acid, nitric acid vapor and alkali metal components discharged from the treatment steps of the method of this invention are recovered in the form of nitric acid or an alkali nitrate, and the so recovered nitric acid or alkali nitrate can be recycled to the heat treatment step or the leaching treatment as the medium or the like.

For example, nitrogen oxides discharged from the fluxing heat treatment and nitrogen oxides discharged from the steps of drying and calcining or decomposing various metal components can all be recovered as nitric acid or an alkali nitrate by means known per se. Nitrogen oxides formed at the heat treatment or decomposition step have, in general, the following composition:

$$NO_x$$

in which $x$ is a number of 1 to 2, though the composition differs to some extent depending of the heat treatment or decomposition conditions.

When the step of absorbing such nitrogen oxides in an aqueous medium and recovering them in the form of nitric acid or an alkali metal nitrate and the step of mixing nitrogen monoxide contained in the exhaust gas with oxygen and passing the gaseous mixture through an oxidation catalyst and combined in this order or reverse order and these operations are repeated until the $NO_x$ content in the exhaust gas from the heat treatment or decomposition step is reduced below 100 ppm, nitrogen oxides can be recovered substantially completely. In a preferred embodiment, an exhaust gas from the fluxing heat treatment step is intimately contacted with water or a dilute aqueous solution of nitric acid to recover nitrogen oxides in the form of nitric acid, the exhaust gas is passed together with oxygen through a layer of an oxidation catalyst to convert nitrogen monoxide contained in the exhaust gas to nitrogen dioxide, and the oxidized gas is contacted with an aqueous solution of an alkali to recover the nitrogen oxides in the form of an alkali metal nitrate.

The contact of the exhaust gas with an aqueous medium (inclusive of dilute nitric acid and an aqueous solution of an alkali) can be performed by using a known gas-liquid catalytic absorption apparatus such as a packed column, a staged column, a spray column, a scrubber, a wetted wall tower, a bubbling column or the like. It is generally preferred that the contact of the exhaust gas with the aqueous medium be conducted at 10° to 40° C.

As the catalyst for converting nitrogen monoxide to nitrogen dioxide, known oxidation catalysts can be used. For example, catalysts comprising an active component such as Pt, Pd, Ro, Rt, Cu, Cr, Ni, Co, Mn, Fe or Bi supported on a known carrier such as alumina, silica, silica-alumina or the like can be advantageously used. Molecular oxygen or air can be used as oxygen to be mixed with the nitrogen monoxide-containing exhaust gas. It is preferred that oxygen be used in an amount about 1.5 to about 2 times the stoichiometric amount to the nitrogen monoxide-containing exhaust gas.

The temperature for the catalytic reaction is changed considerably depending on the catalyst used, but in general, it is preferred that the catalytic reaction be conducted at a temperature of 100° to 450° C. It is also preferred that the space velocity (SV) be within a range of 500 to 20,000 $hr^{-1}$.

The alkali metal component contained in the fluxing reaction product can be substantially removed in the form of an alkali nitrate, except a small amount of the alkali metal component left in the concentrate of the component of the metal of the group IVb of the Periodic Table, by a leaching operation using cold water or warm water or by a leaching operation using an acidic aqueous solution. The so recovered alkali nitrate can be used as the flux repeatedly.

Further, when the respective metal components are separated from the concentrate of the component of the metal of the group IVb of the Periodic Table by using nitric acid according to the preferred embodiment of this invention, the nitric acid component in the waste acid is recovered in the form of a vapor, and it is used again as nitric acid or it is used as dilute nitric acid for the above-mentioned recovery of nitric acid from nitrogen oxides.

According to the method of this invention, which has been detailed hereinbefore, an alkali metal nitrate or an alkali metal peroxide which is a thermal decomposition product of an alkali metal nitrate is used for the fluxing heat treatment of a raw material containing a component of a metal of the group IVb of the Periodic Table and the fluxing heat-treated product is subjected to a leaching treatment using an aqueous medium, whereby coloring poisonous metal components such as Mn, V and Cr components, removal of which has been very difficult according to the conventional techniques, can be selectively separated from the component of the metal of the group IVb of the Periodic Table, the concentrate of the metal of the group IVb of the Periodic Table, from which these poisonous metal components have been removed, can be obtained in a form soluble in an acid, and all the metal components contained in the raw materials can be recovered in industrially valuable forms without formation of industrial wastes causing environmental pollution. Further, since an alkali nitrate is used as the flux for the heat treatment of the raw material, complete recycle of the alkali and nitric acid components becomes possible and the entire operations can be performed in the closed circuit system, whereby the treatment cost can be remarkably reduced and environmental pollution can be effectively prevented.

This invention will now be described in detail by reference to the following examples that by no means limit the scope of the invention and to the accompanying drawings, in which.

EXAMPLE 1

Figure 1:
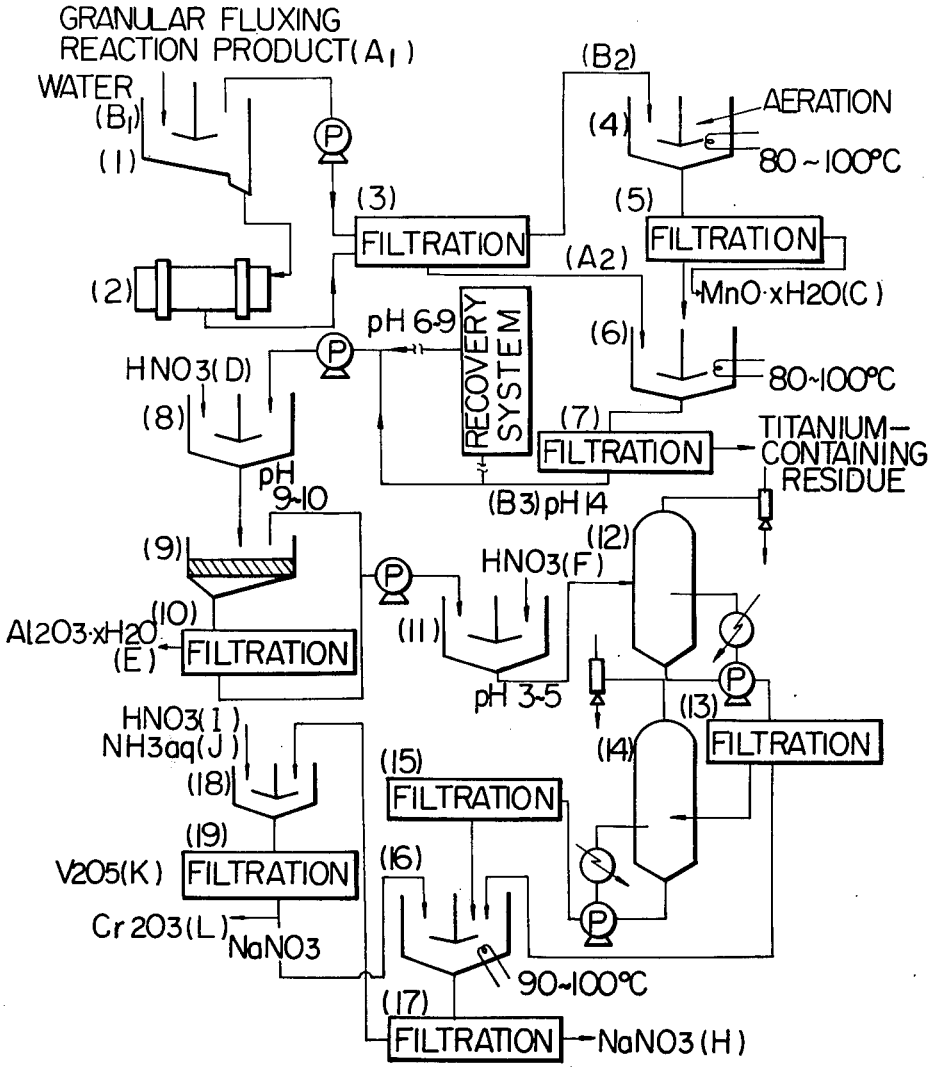
FIG. 1 is a step diagram illustrating the leaching treatment using an aqueous medium, which is adopted in Example 1.

This Example illustrates a method in which a raw material containing a component of a metal of the group IVb of the Periodic Table is subjected to a fluxing heat treatment after it has been processed into a granular form which can easily be handled, and coloring poisonous metal components contained in the raw material are effectively removed.

As the raw material, there were chosen sand iron slag, ilmenite ore, high titanium slag and zircon sand.

As the sand iron slag, there was chosen water-granulated sand iron slag formed as a by-product in refining of sand iron at a plant of Nippon Koshuha K.K., which had a composition shown in Table 1 given hereinafter. This sand iron slag was pulverized in a rotary mill containing alumina balls according to the wet method using water as a medium. Particles capable of passing through a 320-mesh sieve (Tyler standard sieve) were collected, dehydrated and dried. The so obtained powdery sand iron was used as the raw material.

As the ilmenite ore, there was used one produced in USSR and having a composition shown in Table 1 given hereinafter, and the ore was pulverized according to the same wet pulverization method as described above to obtain particles capable of passing through a 320-mesh sieve. The particles were dehydrated and dried, and the resulting pulverized ilmenite was used as the raw material.

As the high titanium slag, there was chosen a product prepared from ilmenite by Quebec Iron and Titanium Co., Canada and having a composition shown in Table 1 given hereinafter. As in the case of the above sand iron slag, the high titanium slag was wet-pulverized to particles capable of passing through a 320-mesh sieve, and dehydrated and dried. The resulting powdery high titanium slag was used as the raw material.

Table 1

| Component (% by weight) | Sand Iron Powder | Ilmenite Powder | High Titanium Slag |
|---|---|---|---|
| $TiO_2$ | 30.94 | 54.84 | 88.82 |
| $SiO_2$ | 22.47 | 1.59 | 3.29 |
| CaO | 22.87 | 0.11 | 0.12 |
| MgO | 6.95 | 0.36 | 1.02 |
| FeO | 5.42 | 40.57 | 4.04 |
| $Al_2O_3$ | 10.35 | 0.91 | 2.54 |
| $V_2O_5$ | 0.52 | 0.15 | 0.33 |
| MnO | 0.97 | 1.94 | 1.17 |
| $Cr_2O_3$ | 0.019 | 0.018 | 0.092 |

As the zircon sand, there was employed one produced in Australia and having a composition of 64.7% by weight of $ZrO_2$, 34.7% by weight of $SiO_2$, 0.02% by weight of $TiO_2$, 0.07% by weight of $Fe_2O_3$, 0.05% by weight of $Al_2O_3$, 0.016% by weight of $Cr_2O_3$, 0.054% by weight of $V_2O_5$ and 0.019% by weight of MnO. This zircon sand was wet-pulverized to particles capable of passing through a 150-mesh sieve in the same manner as described above with respect to the sand iron slag. The particles were dehydrated and dried, and the resulting powdery zircon sand was used.

As the flux, there was chosen sodium nitrate of an industrial grade ($NaNO_3$). It was sieved by using 12- to 42-mesh sieves (Tyler standard sieves) and crystals of sodium nitrate having a size of about 1.4 to about 0.35 mm were used.

The raw material was mixed with sodium nitrate as the flux at a flux mixing ratio (FMR) indicated in Table 2. This flux mixing ratio (FMR) is expressed as follows:

FMR = (weight of flux)/(weight of raw material) A powdery leaching residue (LR-1) described below and having a particle size indicated below was further incorporated as a granulation assistant at a granulation assistant mixing ratio (GAR) indicated in Table 2. This granulation assistant mixing ratio (GAR) is expressed as follows:

GAR = (weight of granulation assistant)/(weight of raw material)

The three components were blended for 30 minutes by using a V-type mixer (having an inner capacity of 100 *l* and a rotation rate of 30 rpm) to prepare a powdery mixture of the three components. The powdery mixture was wetted and the water content was adjusted for granulation of the mixture. At this step, the amount of water was selected so that a water mixing ratio (WCR) indicated in Table 2 was attained. This water mixing ratio (WCR) is expressed as follows:

WCR = (weight of water added)/(weight of raw material) Water application was conducted by spraying water in mists to the mixture by using a pin granulator [a pulverizing granulator described on page 57, Volume Granulation, Plant Operation Series, Chemical Engineering (1968), published by Kagaku Kogyosha], this forming the mixture into granules having a size of about 0.2 to about 12 mm, and drying the granules at 100° to 150° C., which is lower than the melting point of sodium nitrate. In this manner, 31 kinds of granular compositions of the raw material, the flux and the leaching residue, which are indicated in Table 2, were prepared.

A heating furnace of the rotary kiln type was used for the fluxing heat treatment. The rotary kiln had a dimension of 500 mm (diameter) × 2000 mm (length). The inside of the kiln was lined with a refractory cement (Castable Refractory 160 manufactured by Nichibei Rozai Seizo K. K.) so that the inner diameter was 300 mm. This spherical kiln was placed on a rotation stand and a motor was driven so that the kiln was rotated at a rotation rate of 60 rotations per hour. Two rod-like silicon carbide heating elements (length = 2200 mm; Tecornndum manufactured by Toshiba Ceramics) were set at the center of the kiln, so that the inside temperature of the kiln was elevated to about 1200° C. Further, the rotary kiln was arranged so that combustion gas or other gas was not intruded into the kiln from the outside and that a gas to be generated in the kiln by the fluxing reaction, nitrogen oxide ($NO_x$) gas in this case, was introduced in a condensed state into an apparatus for recovering and denitrizing the $NO_x$ gas, which was attached to the rotary heating kiln. Further, the rotary kiln was inclined to some extent so that the granular composition of the three components was continuously fed into the kiln from an introduction opening disposed on one side and the fluxing reaction product was continuously withdrawn from a discharge opening disposed on the other side of the kiln. By this arrangement, the granular composition was maintained at a prescribed temperature for about 10 minutes while being turned by rotation of the kiln and the fluxing reaction was caused in the granular composition sufficiently. Furthermore, by the above arrangement, the fluxing reaction product could be withdrawn from the kiln very easily.

As the apparatus for recovering and denitrizing the nitrogen oxide ($NO_x$) gas, a known nitric acid recovery and denitrizing apparatus shown in FIG. 4 was used, and it was attached to the rotary kiln as an accessory equipment, so that the majority of the nitrogen oxide gas formed by the fluxing reaction was recovered in the form of sodium nitrate or sodium nitrite and a very small part of the $NO_x$ gas having a low concentration (below 1000 ppm.) was reduced by the denitrizing device apparatus and discharged in open air as $N_2$ gas.

The fluxing reaction was conducted by continuously feeding the granular composition of the above three components in the rotary heating kiln while maintaining the inside temperature of the kiln at 900° ± 50° C. and moving the composition from the introduction opening to the discharge opening over a residence time of about 10 minutes in the state turned and rolled in the kiln. Thus, 31 kinds of the granular fluxing reaction products were obtained. With respect to each reaction product, the granular state ("shape of fluxing reaction product" in Table 2) was examined and results are shown in Table 2.

The granular fluxing reaction product thus recovered had a green color when sand iron slag was used, a greenish brown color when ilmenite or high titanium slag was employed, or a grayish brown color when zircon sand was used.

The shape of the fluxing reaction product was evaluated on the following scale and results are shown in Table 2:

◉: excellent granular state
O: good granular state
Δ: semi-molten state
X: molten state Each of the so obtained granular fluxing reaction products was subjected to the leaching treatment described below to remove coloring poisonous metal components therefrom.

As the leaching apparatus, there was employed an agitator-equipped stainless steel leaching tank (having an inner diameter of 600 mm and a height of 700 mm).

The leaching tank was filled with 80 Kg of water and water was heated at about 80° C. by a vapor spiral tube so that the leaching treatment was conducted at 60° ± 10° C. The agitator was arranged so that a sufficient mixing could be attained in the tank. The granular reaction product (40 Kg) was wet-pulverized by using water to obtain particles capable of passing through a 12-mesh sieve (Tyler standard sieve), and the resulting slurry was charged in the leaching tank and the leaching treatment was conducted for 30 minutes by using warm water to thereby dissolve the coloring poisonous metal components in water and recover the leached slurry.

Each slurry thus recovered was subjected to solid-liquid separation using a filter press, to separate it into a filter cake and a filtrate, and the recovered filter cake was washed with warm water (about 80° C.) in an amount corresponding to about ½ of the recovered filtrate. The washing water was combined with the above recovered filtrate. The recovered filter cake was dried at 110° to 150° C. and the recovery ration (RY) of the resulting leaching residue was determined to obtain results shown in Table 2. The recovery ratio (RY) of the leachng residue is expressed as follows:

RY = (weight of recovered leaching residue)/(weight of raw material)

The content of the manganese component in the recovered leaching residue was determined by quantitative analysis, and the degree of removal of the coloring poisonous components contained in the raw material was examined and the removal ratio (%) was determined to obtain results shown in Table 2.

The dried leaching residue recovered from the fluxing reaction product obtained by mixing the three components under conditions in Run 1–13 in Table 2 and performing the fluxing reaction as described above was used as the leaching assistant LR-1 in each Run. This leaching residue was analyzed and it was found that the residue had the following composition:

$Na_2O$ : 22.38% by weight
$TiO_2$ : 25.41% by weight
$SiO_2$ : 16.47% by weight
$Al_2O_3$ : 6.63% by weight
MgO : 5.76% by weight
CaO : 18.76% by weight
FeO : 4.38% by weight
$V_2O_5$ : trace
MnO : 0.02% by weight Among 31 kinds of the fluxing reaction products obtained above, products obtained in Runs 1–13, 1–20, 1–26 and 1–30 were chosen as typical instances of products prepared from the respective raw materials, namely sand iron slag, ilmenite, high titanium slag and zircon sand. With respect to each of these chosen products, MnO, $Cr_2O_3$, $V_2O_5$ and $Al_2O_3$ were separated and recovered from the mother liquor obtained at the warm water leaching treatment and $SiO_2$, $TiO_2$ or $ZrO_2$, CaO, MgO, $Al_2O_3$, $Fe_2O_3$ and $Na_2O$ were separated and recovered from the leaching residue, according to the treatment methods described below. The following explanation refers mainly to run 1–13, but it will be apparent to those skilled in the art that in the case of Runs 1–20, 1–26 and 1–30, treatments could be conducted according to similar procedures.

The treatment of the granular fluxing reaction product will now be described by reference to the treatment step diagram of FIG. 1.

a. Step 1:

The recovered granular fluxing reaction product $A_1$ was charged in a water leaching tank 1 together with 5 liters of water $B_1$ and the mixture was agitated for 30 minutes in the tank 1. The muddy slurry was pumped up and the precipitated residual coarse particles were charged in a ball mill 2 and pulverization and water leaching were conducted in the ball mill 2. The solid and liquid were separated by a filter 3.

The so recovered filtrate [mother liquor ($B_2$)] was charged in an oxidation tank 4 while the residue $A_2$ was charged in a warm water leaching tank 6. To the oxidation tank 4 was fed 0.01 to 0.05% by volume of 30 % aqueous hydrogen peroxide, or air was blown in the tank 4. In this state, the liquid was maintained at 40° to 100° C. for 0.5 to 1 hour, and by this oxidative aging treatment, manganese in the mother liquor ($B_2$) was completely precipitated, and the precipitate was separated by a filter 5 to recover hydrous manganese oxide (C). The recovered filtrate was charged in the warm water leaching tank 6 and maintained at 60° to 100° C. for 0.5 hour under agitation. The mixture was separated and filtered by a filter 7 to recover the mother liquor ($B_3$) and the titanium- or zirconium-containing residue (G).

Ratios of recovery of the respective metal components in the recovered mother liquors $B_2$and $B_3$[ the recovery ratio in the mother liquor $B_2$is added to the recovery ratio in the mother liquor $B_3$; in the instant specification, the recovery ratio in the mother liquor $B_3$ is defined as above; the respective metal components are calculated as oxides ] and the composition of the residue (G) (as measured with respect to the product dried at 100° C.) are shown in Table 3.

In the instant specification, the mother liquor $B_2$, the mother liquor $B_3$, the residue $A_2$ and the residue (G) are those withdrawn at 3, 7, 3 and 7 of the step diagram of FIG. 1, respectively.

Figure 2:
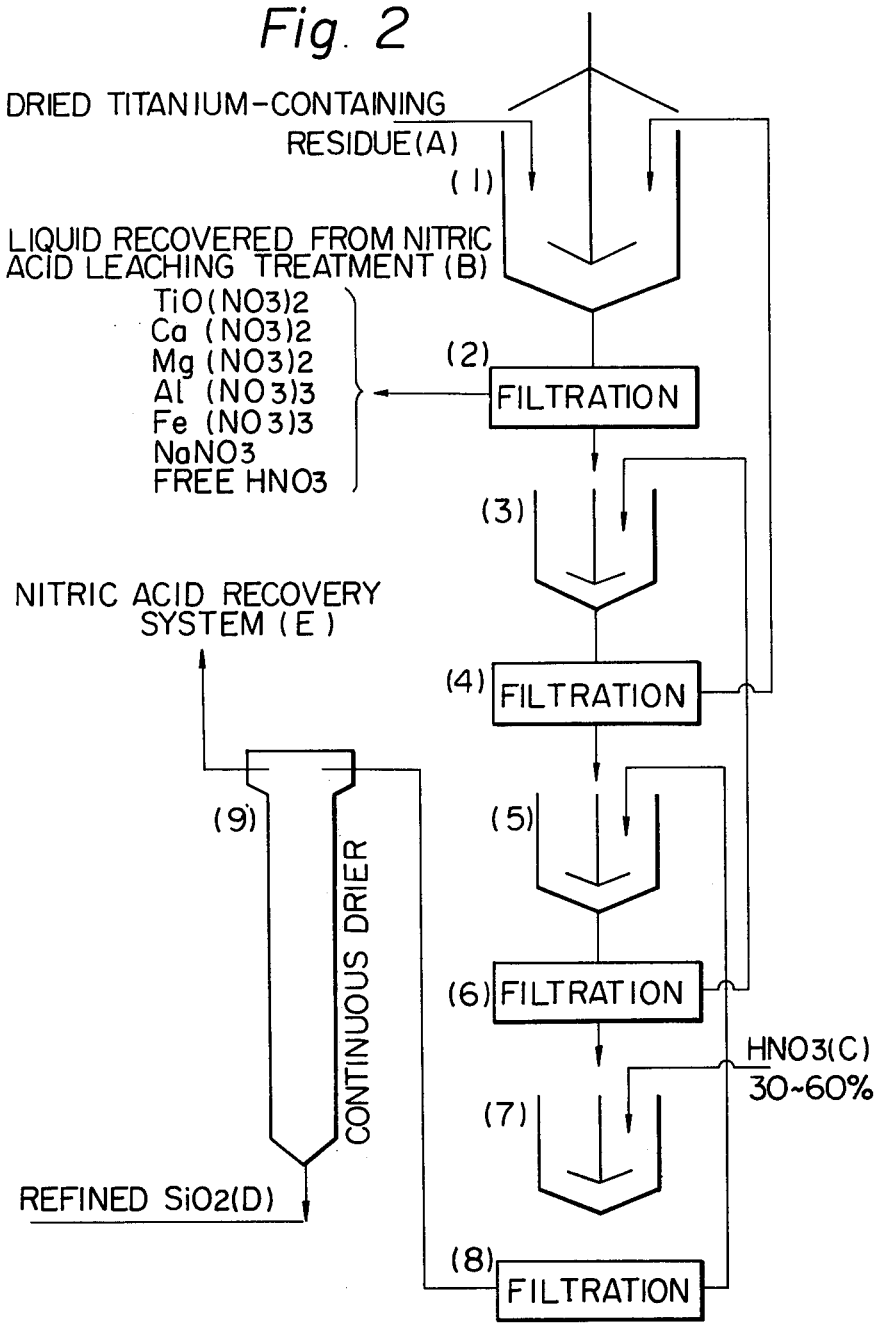
FIG. 2 is a step diagram illustrating the leaching treatment using an acid, which is adopted in Example 1.

The titanium-containing residue (G) from which components of coloring metals such as manganese, chromium and vanadium had been removed, was air-dried at 20° to 100° C. and fed to the nitric acid leaching treatment shown in FIG. 2.

The mother liquor $B_3$ recovered as the concentrated sodium hydroxide was fed to a neutralization tank 8 and a part thereof was used as an absorbing solution for the alkali absorption process for recovering $NO_x$ formed as the by-product at the fluxing reaction. The liquid was used for this absorption process until its pH was 6 to 9 and it was then fed to the neutralization tank 8. In the neutralization tank 8, the pH of the entire liquid was adjusted to 9 to 9.5 by addition of nitric acid (D), whereby aluminum hydroxyde (E) having a relatively good sedimenting property was obtained as the precipitate, and the precipitate was separated and recovered by a desimentation tank 9 and a filter 10.

Then, the filtrate left after removal of aluminum hydroxide (E) was introduced into a neutralization tank 11 where the pH was adjusted to 3 to 5 by nitric acid (F), and the liquid was concentrated by a concentrating tank 12 and a crystallizing tank 14, to thereby crystallize out sodium nitrate (H). The crystal was separated by filters 13 and 15, recrystallized in a recrystallizing tank 16 and separated in a recrystallizing tank 17 to recover sodium nitrate (H) of an industrial grade at a recovery ratio higher than 85%. The so recovered sodium nitrate was recycled to the fluxing step and used as the flux again. Vanadium was contained in the concentrated state in filtrates from the filters 15 and 17. Accordingly, these filtrates were conmbined and treated according to a known method using nitric acid (I) and aqueous ammonia (J), and a crystal of ammonium metavanadate was recovered at a vandium recovery tank 18 and a filter 19. Chromic acid (L) and sodium nitrate were recovered from the filtrate from the filter 19 by means known per se. (b) Step 2:

The nitric acid leaching treatment will now be described by reference to FIG. 2.

About 1.3 Kg of the dry titanium- or zirconium-containing residue (G) [ (A) in FIG. 2 ] was gradually charged under agitation to a nitric acid leaching tank 11 filled with about 2 liters of a filtrate separated at a filter 4 described below.

In the tank 11, the nitric acid leaching treatment was conducted for 1 to 2 hours under mild agitation, whereby the silica component was converted to a silica hydrogel having a good sedimenting property, and titanium or zirconium, calcium, magnesium, aluminum and iron were included in the solution phase in the form of nitrates. The mixture from the tank 11 was separated and filtered to recover about 2 liters of a nitric acid solution (B) of titanium having a composition indicated in Table 3 (the contained metal components are expressed as oxides). The separated silica hydrogel was charged in a dispersing and washing tank filled with about 2 liters of a filtrate separated at the filter 6 described below, and it was dispersed and washed for 10 to 30 minutes under mild agitation. Then, the gel was filtered by a filter 4 and charged in a dispersing and washing tank 5 filled with about 2 liters of a filtrate separated at a filter 8 described below and was dispersed and washed for 10 to 30 minutes, and it was filtered by the filter 6 and fed to a dispersing and washing tank 7. About 2 to about 2.5 liters of purified nitric acid (C) having a concentration of 30 to 60% was added and dispersing washing was conducted for 10 to 20 minutes under mild agitation. Then, the washed gel was filtered by the filter 8 and fed into a continuous drier 9. Thus, a purified silica gel (D) was obtained.

Figure 4:
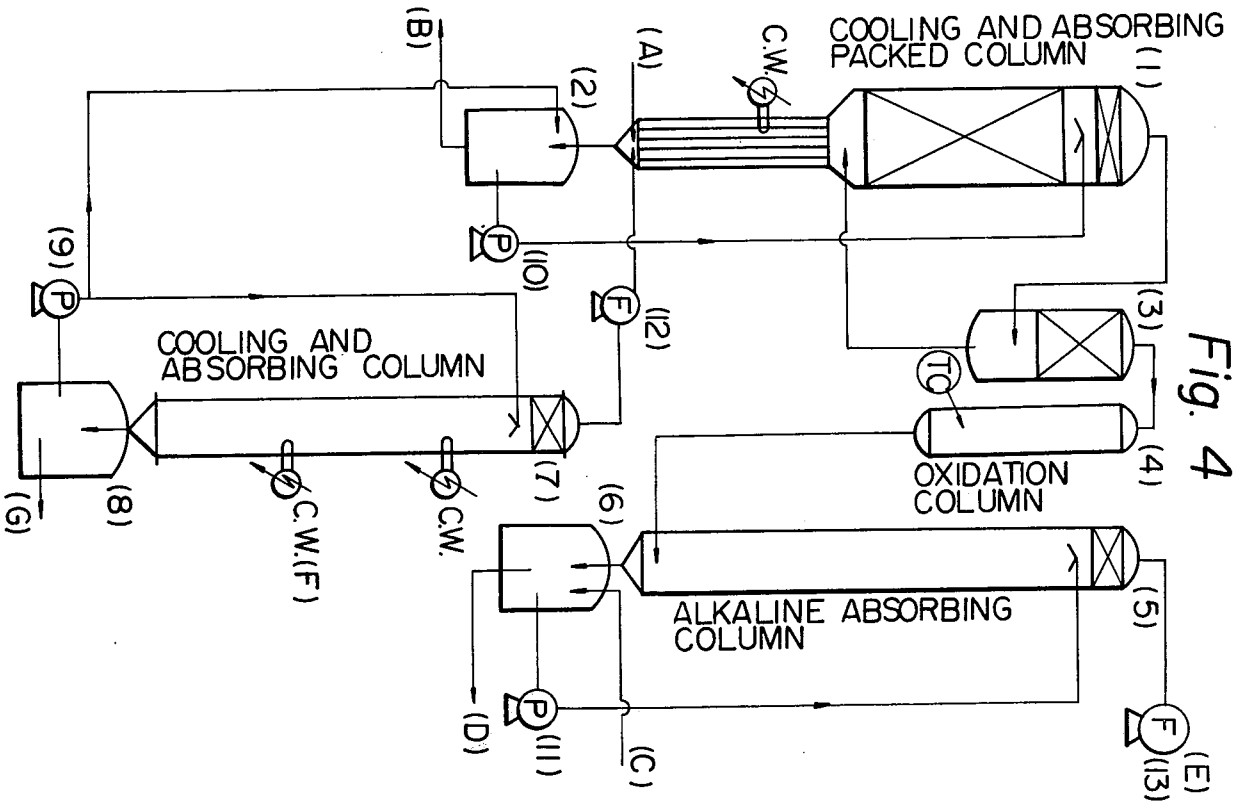
FIG. 4 is a step diagram illustrating the treatment of recovery of nitric acid, which is adopted in Example 1.

The nitric vapor (E) distilled at this step was fed to the nitric acid recovery system shown in FIG. 4. (c) Step 3:

The method of recovery of the titanium component will now be described specifically by reference to the titanium-containing residue obtained in Run 1–13.

Figure 3:
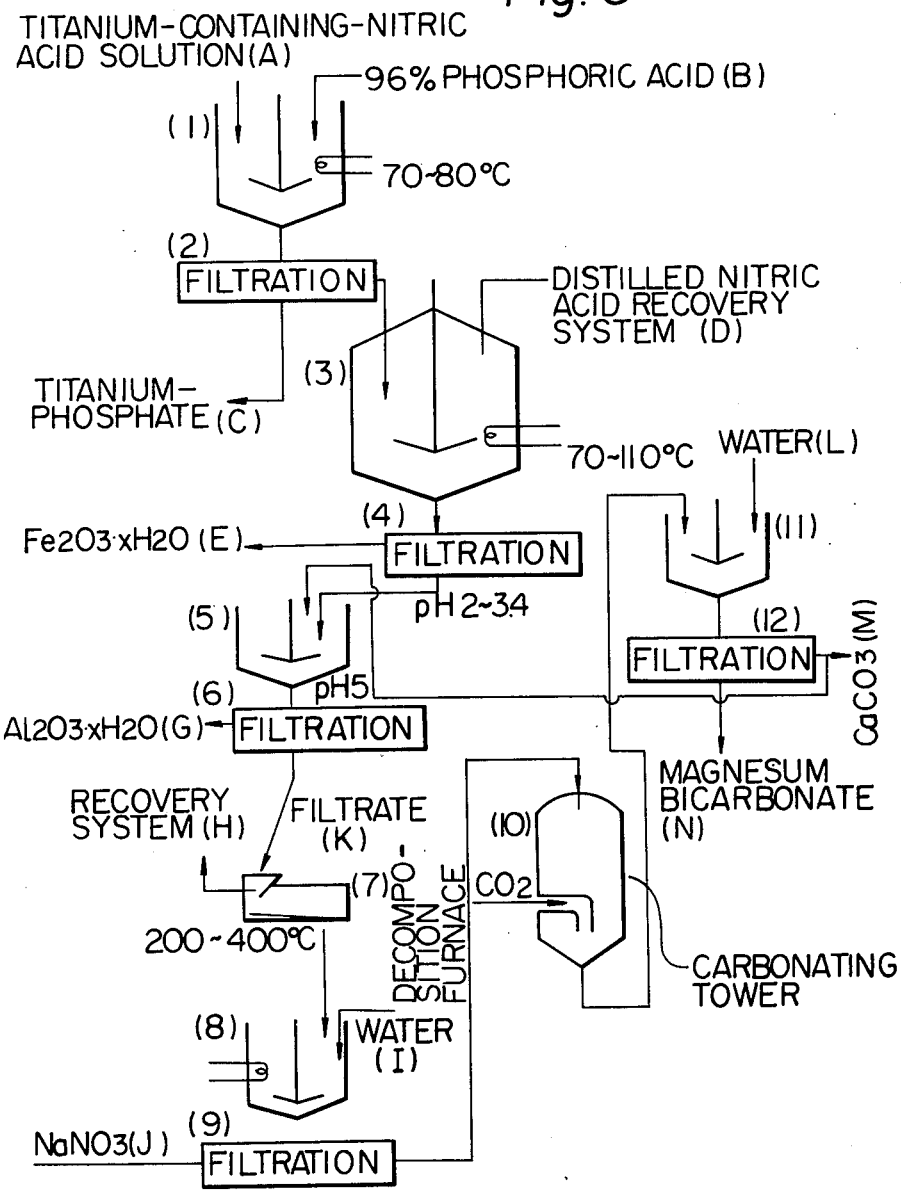
FIG. 3 is a step diagram illustrating the treatment of recovery of the titanium component and copresent metal components, which is adopted in Example 1.

The steps for recovery of the titanium component and copresent metal components are illustrated in the step diagram of FIG. 3.

About 2 liters of the above-mentioned titanium nitrate-containing solution [(A) in FIG. 3][the liquid recovered at the nitric acid leaching treatment by the filtration (2) in FIG. 2] was charged in a reaction tank 1, and according to the method disclosed in Japanese Patent Publication No. 19520/74, 96% phosphoric acid of the first grade for industrial uses was added in such an amount that the ratio of $P_2O_5$ to $TiO_2$ in the above nitric acid solution was 2 : 1 and the mixture was agitated at a temperature lower than 80° C. to precipitate titanium phosphate. Aging was conducted for 1 hour and the mixture was filtered by a filter 2. The recovered precipitate of the titanium phosphate was washed with an acid and then with water to obtain a purely white titanium phosphate (C) substantially free of coloring metal componets such as iron, manganese, vanadium and chromium componets. The recovery ratio of the titanium component was as high as 97%. The filtrate from the tilter 2 was charged in a concentrating and distillation tank 3 and concentrated by heating under atmospheric or reduced pressure. Most of iron nitrate was hydrolyzed to hydrous iron oxide, and simultaneously, free nitric acid was recovered as distilled nitric acid (D), which was then fed to a cooling and absorbing column 8 shown in FIG. 4.

Then, a small quantity of water was added to the resulting concentration sludge and it was further heated and aged in the concentrating and distillation tank 3 to precipitate the iron component completely. This hydrate of iron oxide was filtered and separated by a filter 4. Since the pH of the filtrate obtained at this point was 2 to 3.4, the filtrate was fed to a neutralization tank 5 and neutralized to a pH of 5 by addition of a small amount of calcium carbonate or calcium oxide, whereby aluminum oxide (G) was recovered as the precipitate. The precipitate was filtered and separated by a filter 6, and the filtrate (K) was recovered. The filtrate was analyzed to obtain results shown in Table 3 (the respective metal components are expressed as oxides).

Then, the filtrate (K) was concentrated and thermally decomposed at a thermal decomposition furnace 7 at a temperature of 200° to 400° C., whereby calcium nitrate and magnesium nitrate were readily decomposed to calcium oxide and magnesium oxide while releasing $NO_2$ (H). However, by this treatment, sodium nitrate was hardly decomposed and hence, the entire system retained a flowable state. Accordingly, this mixture could easily be withdrawn from the decomposition furnace 7 continuously. The mixture was immediately charged in a heating and dissolving tank 8 and water (I) was added according to need. Thus, sodium nitrate was dissolved and a sodium nitrate solution (J) was recovered by a filter 9 and fed to the recrystallizing tank 16 shown in FIG. 1.

The powdery mixture of calcium oxide and magnesium oxide was fed into a carbon dioxide absorbing column 10, and according to the known method, carbon dioxide gas was blown into the column 10 to convert calcium oxide and magnesium oxide to calcium carbonate (M) and soluble magnesium bicarbonate (N), respectively. Both the compounds were fed to a dissolving tank 11, and water was added according to need and separation was conducted by a filter 12. A part of the calcium carbonate thus recovered was recycled to the neutralization tank 5 and used as a neutralizer (F). (d) Step 4:

The step of recovery of nitric acid will now be described by reference to FIG. 4.

Distilled nitric acid from the step shown in FIG. 2 and the vapor of nitric acid (D) from the step shown in FIG. 3 were introduced into a cooling and absorbing column 7 and the gas was recovered in a store tank 8 as liquid nitric acid having a concentration of 30 to 45%. This nitric acid was fed to a store tank 2 by a pump 9 and was used an absorbant for the absorbing column 1. $NO_x$ gas fed by a fan 12, $NO_x$ gas generated at the fluxing heat treatment and $NO_x$ gas from the step shown in FIG. 3 where introduced together into the bottom of the cooling and absorbing packed column 1 and they were recovered as nitric acid. Thus, nitric acid (B) having a concentration of 50 to 60% was obtained from the store tank 2 and it was recycled to the nitric acid leaching step shown in FIG. 2 and used as the leaching medium.

The exhaust gas which had not been absorbed in the cooling and absorbing packed column 1 was passed through a mist eliminator 3 and oxidized in an oxidation column 4. Then, the oxidized gas was introduced to the bottom of an alkali absorbing column 5 and contacted with the above-mentioned alkali-treated liquid (C) having a pH of 14 which was filled in a store tank 6 and fed to the column 5 by a pump 11, whereby the nitrogen oxide was abosrbed in the liquid and removed from the gas. Then, the exhaust gas (E) having hardly any smell of the nitrogen oxide was discharged from a fan 13. Simultaneously, the nitrogen oxide-absorbed solution (D) having a pH of 6 to 9 obtained in the store tank 6 was returned to the neutralizing tank 8 shown in FIG. 1 as described above, and instead, the alkali solution having a pH of 14, which was recovered by the filter 7 shown in FIG. 1 was filled into the store tank 6.

From the results shown in Tables 2 and 3, it will readily be understood that when raw materials containing components of metals of the group IVb of the Periodic Table, such as sand iron slag, ilmenite ore, high titanium slag and zircon sand, are heat-treated to effect fluxing reaction, if a part of the leaching residue is used as the granulation assistant and it is incorporated in such an amount that the granulation assistant mixing ratio ( GAR ) is at least 2, the fluxing heat treatment can be conducted while keeping the starting composition in the non-sticky granular easily-handling state throughout the fluxing heat treatment and preventing the starting composition from being molten and formed into a molten liquid which is very difficult to handle.

Table 2

| Raw Material | Run No. | Flux Mixing Ratio (FMR) | Granulation Assistant Mixing Ratio (WCR) | Water Mixing Ratio (WCR) | Shape of Fluxing Reaction Product | Leaching Residue Recovery Weight Ratio (RY) | MnO Removal Ratio (%) |
|---|---|---|---|---|---|---|---|
| Sand Iron Slag | 1 - 1 | 3.5 | 1.0 | 0.1 | × | 2.4 | 83.9 |
| | 1 - 2 | 3.5 | 1.1 | 0.1 | Δ | 2.5 | 94.5 |
| | 1 - 3 | 3.5 | 1.2 | 0.1 | ○ | 2.6 | 89.6 |
| | 1 - 4 | 3.5 | 1.3 | 0.1 | ⊙ | 2.73 | 93.5 |
| | 1 - 5 | 3.5 | 1.4 | 0.1 | ⊙ | 2.8 | 91.6 |
| | 1 - 6 | 3.5 | 1.5 | 0.1 | ⊙ | 2.9 | 92.3 |
| | 1 - 7 | 3.5 | 1.7 | 0.1 | ⊙ | 3.1 | 82.4 |
| | 1 - 8 | 3.5 | 2.0 | 0.1 | ⊙ | 3.4 | 83.5 |
| | 1 - 9 | 3.0 | 1.4 | 0.1 | ⊙ | 2.74 | 80.9 |
| | 1 - 10 | 4.0 | 1.4 | 0.1 | ○ | 2.86 | 92.9 |
| | 1 - 11 | 4.5 | 1.4 | 0.1 | ⊙ | 2.91 | 95.4 |
| | 1 - 12 | 3.5 | 1.4 | 0.05 | ⊙ | 2.8 | 91.9 |
| | 1 - 13 | 3.5 | 1.4 | 0.15 | ⊙ | 2.76 | 94.9 |
| | 1 - 14 | 3.5 | 1.4 | 0.20 | ⊙ | 2.8 | 93.6 |
| | 1 - 15 | 3.5 | 1.4 | 0.25 | ⊙ | 2.82 | 93.4 |
| Ilmenite | 1 - 16 | 3.5 | 1.2 | 0.1 | ⊙ | 2.63 | 80.5 |
| | 1 - 17 | 3.5 | 1.3 | 0.1 | ⊙ | 2.73 | 92.4 |
| | 1 - 18 | 3.5 | 1.4 | 0.1 | ⊙ | 2.84 | 83.5 |
| | 1 - 19 | 3.5 | 1.5 | 0.1 | ⊙ | 2.92 | 90.9 |
| | 1 - 20 | 4.0 | 1.4 | 0.2 | ⊙ | 3.0 | 93.4 |
| | 1 - 21 | 4.0 | 1.5 | 0.2 | ⊙ | 2.99 | 88.4 |
| | 1 - 22 | 4.0 | 1.5 | 0.25 | ⊙ | 3.1 | 92.6 |
| High Titanium Slag | 1 - 23 | 3.5 | 1.3 | 0.1 | ⊙ | 2.93 | 89.3 |
| | 1 - 24 | 3.5 | 1.5 | 0.1 | ⊙ | 3.12 | 87.4 |
| | 1 - 25 | 4.0 | 1.4 | 0.15 | ○ | 3.13 | 92.4 |
| | 1 - 26 | 4.0 | 1.5 | 0.20 | ⊙ | 3.22 | 90.8 |
| | 1 - 27 | 4.0 | 1.5 | 0.25 | ⊙ | 3.23 | 91.5 |
| Zircon Sand | 1 - 28 | 1.5 | 1.2 | 0.05 | ⊙ | 2.6 | 96 |
| | 1 - 29 | 1.5 | 1.3 | 0.05 | ⊙ | 2.73 | 97.5 |
| | 1 - 30 | 2.0 | 1.4 | 0.05 | ⊙ | 2.95 | 100 |
| | 1 - 31 | 2.5 | 1.5 | 0.10 | ⊙ | 3.14 | 100 |

Table 3

| Run No. | Recovery Ratio (mother liquor) (%) | | | | | | Composition (% by weight) of Leaching Residue | | | | | |
|---|---|---|---|---|---|---|---|---|---|---|---|---|
| | MnO | $Cr_2O_3$ | $V_2O_5$ | $Al_2O_3$ | $SiO_2$ | $Na_2O$ | $TiO_2$ or $ZrO_2$ | $SiO_2$ | $Al_2O_3$ | MgO | CaO | FeO |
| 1 - 13 | 94.9 | 96.92 | 97.56 | 21.5 | 0 | 87 | 25.39 | 16.59 | 6.62 | 5.7 | 18.77 | 4.44 |
| 1 - 20 | 93.4 | 100 | 93 | 100 | 0 | 84.5 | 41.39 | — | — | 0.27 | 0.08 | 30.62 |
| 1 - 26 | 90.8 | 100 | 99 | 100 | 0 | 82.5 | 66.02 | — | — | 0.73 | 0.08 | 3.0 |
| 1 - 30 | 100 | 100 | 100 | 100 | 94.3 | 79.4 | 59.96 | 1.82 | — | — | — | — |

| Composition (% by weight) of Solution Recovered from Nitric Acid Leaching Step | | | | | | | | | | Composition (% by weight) of Filtrate (A) | | |
|---|---|---|---|---|---|---|---|---|---|---|---|---|
| MnO | $Cr_2O_3$ | $V_2O_5$ | $Na_2O$ | $TiO_2$ or $ZrO_2$ | CaO | MgO | $Al_2O_3$ | FeO | $Na_2O$ | CaO | MgO | $Na_2O$ |
| 0.02 | — | 0.005 | 22.45 | 30.45 | 22.5 | 6.83 | 7.95 | 5.32 | 26.9 | 41.5 | 12.14 | 45.4 |
| 0.03 | — | 0.004 | 27.6 | 41.42 | 0.07 | 0.27 | — | 30.65 | 25.9 | | | |
| 0.02 | — | 0.002 | 30.16 | 64.95 | 0.03 | 0.8 | — | 3.07 | 28.9 | | | |
| — | — | — | 38.19 | 60.5 | — | — | — | — | 36.8 | | | |

EXAMPLE 2

This Example illustrates experiments conducted by changing the amount of sodium nitrate added as the flux.

The same fine powder of ilmenite used as in Example 1 was chosen as the ilmenite raw material, and the same fine powder of sand iron slag as used in Example 1 was chosen as the sand iron slag raw material.

Sodium nitrate was added as the flux to the raw material in an amount 1, 2, 3 or 5 times the amount of the raw material on the weight base. The raw material and the flux was sufficiently mixed according to the method described in Example 1, and the mixture was heated at 850° C. for 1 hour to effect fluxing reaction in the flown state, whereby a fluxing reaction product having a bluish green color was obtained.

According to the method described in (a) step 1 of Example 1, each reaction product was leached with water and warm water. Recovery ratios of the respective components in the mother liquor ($B_2$) and mother liquor ($B_3$), which were recovered in the same manner as in Example 1, and the composition of the residue (G) are shown in Table 4.

As will be apparent from the results shown in Table 1, in order to obtain a titanium-containing residue (G), from which coloring components other than the iron component have been effectively removed, by treating ilmenite and sand iron slag according to the method of this invention, it is preferred that sodium nitrate as the flux be used in an amount at least 3 times, especially at least 4 times, the amount of the raw material on the weight basis.

Table 4

| Component | Raw Material / $NaNO_3$ (weight ratio) 1/1 | | 1/2 | | 1/3 | | 1/4 | | 1/5 | |
|---|---|---|---|---|---|---|---|---|---|---|
| MnO | 30.5 | (0.990) | 47.3 | (1.04) | 79.6 | (0.41) | 98 | (0.06) | 84.3 | (0.31) |
| | 22.3 | (0.757) | 29.6 | (0.687) | 68.4 | (0.314) | 99.3 | (0.0065) | 79.3 | (0.21) |
| $Cr_2O_3$ | 29.6 | (0.0128) | 74 | (0.013) | 93.4 | (0.0012) | 100 | (0) | 100 | (0) |
| | 36.5 | (0.012) | 40.6 | (0.0113) | 86.5 | (0.0026) | 96.5 | (0.0001) | 94.6 | (0.0012) |
| $V_2O_5$ | 47.0 | (0.081) | 68.0 | (0.048) | 84.5 | (0.024) | 93 | (0.01) | 89.6 | (0.016) |
| | 48.3 | (0.270) | 56.3 | (0.228) | 79.4 | (0.109) | 97.56 | (0.012) | 88.6 | (0.063) |
| $Al_2O_3$ | 28.4 | (0.653) | 36.5 | (0.59) | 74.9 | (0.237) | 100 | (0) | 100 | (0) |
| | 4.9 | (9.89) | 5.6 | (9.83) | 15.3 | (8.96) | 23.6 | (8.54) | 25.4 | (8.27) |
| $SiO_2$ | 59.4 | (0.657) | 60.4 | (0.30) | 96.5 | (0.058) | 100 | (0) | 100 | (0) |
| | 0 | (22.57) | 0 | (22.62) | 0 | (22.96) | 0 | (21.4) | 14.5 | (20.57) |
| CaO | 0 | (0.112) | 0 | (0.112) | 0 | (0.114) | 0 | (0.114) | 0 | (0.114) |
| | 0 | (22.97) | 0 | (23.02) | 0 | (23.37) | 0 | (24.2) | 0 | (24.49) |
| MgO | 0 | (0.366) | 0 | (0.366) | 0 | (0.372) | 0 | (0.375) | 0 | (0.374) |
| | 0 | (6.98) | 0 | (6.99) | 0 | (7.104) | 0 | (7.35) | 0 | (7.44) |
| FeO | 0 | (41.29) | 0 | (41.32) | 0 | (42.0) | 0 | (42.27) | 0 | (42.17) |
| | 0 | (5.44) | 0 | (5.45) | 0 | (5.54) | 0 | (5.73) | 0 | (5.80) |
| $TiO_2$ | 0 | (55.82) | 0 | (55.86) | 0 | (56.78) | 0 | (57.14) | 0 | (57.0) |
| | 0 | (31.08) | 0 | (31.14) | 0 | (31.63) | 0 | (32.74) | 0 | (33.13) |

Notes:

1. Parenthesized values denote the composition of the residue (G).
2. In each item, the value of the upper line denotes a value obtained with respect to the case where ilmenite was used as the raw material, and the value of the lower line denotes a value obtained with respect to the case where sand iron slag was used as the raw material.

EXAMPLE 3

In this Example, in the same manner as in Example 2, ilmenite and sand iron slag were used as raw materials and subjected to the fluxing heat treatment while maintaining the raw material/flux weight ratio at ¼, but the fluxing temperature and time were changed as indicated in Table 5.

According to the method described in (a) step 1 of Example 1, leaching was conducted by using water and warm water. Recovery ratios of the respective components recovered in the mother liquor ($B_2$) and the mother liquor ($B_3$) and the composition of the residue (G) are shown in Table 5.

From the results shown in Table 5, it will readily be understood that in order to separate and recover the respective components effectively, it is necessary that the fluxing heat treatment should be conducted at 750° to 950° C.

Table 5

| Component | Temperature (° C.) × Time (hour) 400 × 1 | | 700 × 1 | | 800 × 1 | | 850 × 0.5 | | 850 × 1 | |
|---|---|---|---|---|---|---|---|---|---|---|
| MnO | 0 | (1.94) | 43.3 | (1.12) | 68.4 | (0.63) | 88.4 | (0.21) | 98 | (0.06) |
| | 0 | (0.97) | 53.4 | (0.47) | 78.7 | (0.22) | 93.5 | (0.07) | 99.3 | (0.0065) |
| $Cr_2O_3$ | 0 | (0.018) | 49.3 | (0.01) | 69.4 | (0.005) | 84.3 | (0.003) | 100 | (0) |
| | 0 | (0.019) | 67.6 | (0.006) | 87.4 | (0.002) | 87.3 | (0.002) | 96.92 | (0.0001) |
| $V_2O_5$ | 0 | (0.15) | 38.4 | (0.09) | 69.3 | (0.047) | 79.8 | (0.03) | 93 | (0.01) |
| | 0 | (0.52) | 58.3 | (0.23) | 82.5 | (0.10) | 90.3 | (0.06) | 97.56 | (0.012) |
| $Al_2O_3$ | 0 | (0.91) | 39.2 | (0.56) | 68.4 | (0.29) | 86.5 | (0.12) | 100 | (0) |
| | 0 | (10.35) | 10.3 | (9.60) | 30.4 | (7.94) | 25.6 | (8.57) | 23.6 | (8.54) |
| $SiO_2$ | 0 | (1.59) | 42.5 | (0.92) | 73.8 | (0.43) | 98.6 | (0.02) | 100 | (0) |
| | 0 | (22.47) | 8.6 | (21.25) | 24.3 | (18.75) | 29.4 | (17.69) | 0 | (21.4) |
| FeO | 0 | (40.57) | 0 | (41.12) | 0 | (41.71) | 0 | (42.14) | 0 | (42.27) |
| | 0 | (5.42) | 0 | (5.61) | 0 | (5.98) | 0 | (6.02) | 0 | (5.73) |

| Component | 850 × 2 | | 900 × 1 | | 1000 × 1 | |
|---|---|---|---|---|---|---|
| MnO | 86.5 | (0.27) | 97.5 | (0.05) | 64.5 | (0.70) |
| | 79.3 | (0.21) | 92.5 | (0.076) | 54.6 | (4.49) |
| $Cr_2O_3$ | 78.3 | (0.004) | 89.4 | (0.002) | 59.6 | (0.007) |
| | 65.3 | (0.009) | 88.6 | (0.002) | 65.3 | (0.007) |
| $V_2O_5$ | 84.5 | (0.02) | 92.9 | (0.01) | 58.3 | (0.06) |
| | 83.4 | (0.089) | 98.5 | (0.008) | 59.5 | (0.215) |
| $Al_2O_3$ | 97.9 | (0.02) | 97.5 | (0.02) | 62.3 | (0.34) |
| | 29.5 | (7.58) | 26.3 | (7.92) | 15.4 | (8.93) |
| $SiO_2$ | 100 | (0) | 100 | (0) | 34.5 | (1.06) |
| | 0 | (23.34) | 0 | (23.32) | 0 | (22.91) |
| FeO | 0 | (42.17) | 0 | (42.27) | 0 | (41.39) |
| | 0 | (5.63) | 0 | (5.62) | 0 | (5.53) |

| Component | 400 × 1 | | 700 × 1 | | 800 × 1 | | 850 × 0.5 | | 850 × 1 | |
|---|---|---|---|---|---|---|---|---|---|---|
| CaO | 0 | (0.11) | 0 | (0.11) | 0 | (0.11) | 0 | (0.11) | 0 | (0.114) |
| | 0 | (22.87) | 0 | (23.66) | 0 | (25.22) | 0 | (25.44) | 0 | (24.20) |
| MgO | 0 | (0.36) | 0 | (0.37) | 0 | (0.37) | 0 | (0.37) | 0 | (0.375) |
| | 0 | (6.95) | 0 | (7.19) | 0 | (7.66) | 0 | (7.73) | 0 | (7.35) |
| $TiO_2$ | 0 | (54.84) | 0 | (55.65) | 0 | (56.39) | 0 | (56.97) | 0 | (57.14) |
| | 0 | (30.94) | 0 | (32.00) | 0 | (34.12) | 0 | (34.42) | 0 | (32.74) |
| $Na_2O$ | | | | | | | | | 84.5 | (—) |
| | | | | | | | | | 87 | (—) |

| Component | 850 × 2 | | 900 × 1 | | 1000 × 1 | |
|---|---|---|---|---|---|---|
| CaO | 0 | (0.11) | 0 | (0.11) | 0 | (0.11) |
| | 0 | (23.76) | 0 | (23.73) | 0 | (23.42) |
| MgO | 0 | (0.37) | 0 | (0.37) | 0 | (0.37) |
| | 0 | (7.22) | 0 | (7.21) | 0 | (7.08) |
| $TiO_2$ | 0 | (57.01) | 0 | (57.14) | 0 | (55.95) |
| | 0 | (32.14) | 0 | (32.11) | 0 | (31.55) |

Table 5-continued

| Component | Temperature (° C.) × Time (hour) |
|---|---|
| $Na_2O$ | |

Notes:

1. Parenthesized values denote the composition of the residue (G).
2. In each item, the value of the upper line denotes a value obtained with respect to the case where ilmenite was used as the raw material and the value of the lower line denotes a value obtained with respect to the case where sand iron slag was used as the raw material.

EXAMPLE 4

In the same manner as described in Example 2, ilmenite and sand iron sålg were used as the raw materials, and they were heat-treated in a non-reducing atmosphere by using an alkali nitrate and a granulation assistant shown in Table 1 in combination (no granulation assistant was added in Runs 1 and 2). Coloring components and soluble components were removed by using water and warm water in the same manner as described at (a) step 1 of Example 1.

The raw material/flux weight ratio was adjusted to $\frac{1}{4}$ and the granulation assistant was incorporated in an amount of 40% by weight based on the alkali nitrate. Other granulation conditions were the same as in Example 1. The granulated composition was maintained at 850° C. for 1 hour in a furnace. In the same manner as in Example 1, the state of the fluxing reaction product was examined to obtain results shown in Table 6.

Recovery ratios of the respective components in the mother liquors ($B_2$) and ($B_3$) and the composition of the residue (G) are shown in Table 6.

Table 6

| Run No. | Flux and Granulation Assistant | Recovery Ratio and Composition | | | | | | | | | |
|---|---|---|---|---|---|---|---|---|---|---|---|
| | | MnO | | $Cr_2O_3$ | | $V_2O_5$ | | $Al_2O_3$ | | $SiO_2$ | |
| | | 87.4 | (0.24) | 69.6 | (0.005) | 68.6 | (0.005) | 89.6 | (0.009) | 96.4 | (0.06) |
| 1 | $KNO_3$ | 86.4 | (0.14) | 83.6 | (0.003) | 87.6 | (0.06) | 28.6 | (7.99) | 15.7 | (20.39) |
| | | 93.5 | (0.14) | 70.8 | (0.005) | 88.9 | (0.02) | 100 | (0) | 100 | (0) |
| 2 | $NaNO_2$ | 89.6 | (0.11) | 98.6 | (0.0003) | 90.3 | (0.05) | 17. | (9.32) | 23 | (18.76) |
| | $NaNO_3$ | 96.7 | (0.06) | 97.4 | (0.0005) | 90.5 | (0.01) | 100 | (0) | 100 | (0) |
| 3 | $Na_2O_2$ | 93.4 | (0.07) | 100 | (0) | 87.3 | (0.08) | 15 | (9.70) | 30 | (17.28) |
| | $NaNO_3$ | 69.4 | (0.62) | 78.6 | (0.004) | 83.5 | (0.03) | 96.4 | (0.03) | 95.3 | (0.07) |
| 4 | $NaCO_3$ | 94.0 | (0.07) | 69.2 | (0.007) | 89.7 | (0.06) | 19.8 | (9.29) | 34.6 | (16.46) |
| | $NaNO_3$ | 78.6 | (0.43) | 88.7 | (0.002) | 76.4 | (0.04) | 100 | (0) | 100 | (0) |
| 5 | NaOH | 76.4 | (0.22) | 65.4 | (0.007) | 90.4 | (0.055) | 19.4 | (9.19) | 30.6 | (17.26) |
| | $NaNO_3$ | 83.2 | (0.25) | 88.4 | (0.002) | 72.3 | (0.02) | 80.4 | (0.185) | 92.3 | (0.12) |
| 6 | borax | 79.5 | (0.22) | 90.5 | (0.002) | 74.3 | (0.148) | 54.6 | (5.29) | 14.6 | (21.2) |
| | $NaNO_3$ | 87.4 | (0.21) | 87.6 | (0.002) | 86.3 | (0.02) | 100 | (0) | 100 | (0) |
| 7 | MgO | 98.4 | (0.02) | 89.4 | (0.002) | 90.4 | (0.06) | 79.4 | (2.42) | 17.6 | (21.30) |

| | | CaO | | MgO | | FeO | | $TiO_2$ | | Shape of Fluxing Reaction Product |
|---|---|---|---|---|---|---|---|---|---|---|
| | | 0 | (0.11) | 0 | (0.37) | 0 | (42.12) | 0 | (42.12) | |
| 1 | $KNO_3$ | 0 | (24.68) | 0 | (7.50) | 0 | (5.85) | 0 | (33.39) | × |
| | | 0 | (0.11) | 0 | (0.37) | 0 | (42.24) | 0 | (57.10) | |
| 2 | $NaNO_2$ | 0 | (24.80) | 0 | (7.50) | 0 | (5.88) | 0 | (33.55) | × |
| | $NaNO_3$ | 0 | (0.11) | 0 | (0.37) | 0 | (42.28) | 0 | (57.15) | |
| 3 | $Na_2O_2$ | 0 | (25.18) | 0 | (7.65) | 0 | (5.97) | 0 | (34.07) | × |
| | $NaNO_3$ | 0 | (0.11) | 0 | (0.37) | 0 | (41.99) | 0 | (56.76) | |
| 4 | $NaCO_3$ | 0 | (25.61) | 0 | (7.78) | 0 | (6.07) | 0 | (34.65) | × |
| | $NaNO_3$ | 0 | (0.11) | 0 | (0.37) | 0 | (42.10) | 0 | (56.87) | |
| 5 | NaOH | 0 | (25.32) | 0 | (7.70) | 0 | (6.00) | 0 | (34.25) | × |
| | $NaNO_3$ | 0 | (0.114) | 0 | (0.373) | 0 | (42.06) | 0 | (56.86) | |
| 6 | borax | 0 | (25.27) | 0 | (7.68) | 0 | (5.98) | 0 | (34.19) | × |
| | $NaNO_3$ | 0 | (0.11) | 0 | (0.37) | 0 | (42.22) | 0 | (57.06) | |
| 7 | MgO | 0 | (26.33) | 0 | (8.0) | 0 | (6.24) | 0 | (35.62) | |
| | | 0 | (0.11) | 0 | (0.37) | 0 | (42.12) | 0 | (42.12) | |
| 1 | $KNO_3$ | 0 | (24.68) | 0 | (7.50) | 0 | (5.85) | 0 | (33.39) | × |
| | | 0 | (0.11) | 0 | (0.37) | 0 | (42.24) | 0 | (57.10) | |
| 2 | $NaNO_2$ | 0 | (24.80) | 0 | (7.50) | 0 | (5.88) | 0 | (33.55) | × |
| | $NaNO_3$ | 0 | (0.11) | 0 | (0.37) | 0 | (42.28) | 0 | (57.15) | |
| 3 | $Na_2O_2$ | 0 | (25.18) | 0 | (7.65) | 0 | (5.97) | 0 | (34.07) | × |
| | $NaNO_3$ | 0 | (0.11) | 0 | (0.37) | 0 | (41.99) | 0 | (56.76) | |
| 4 | $NaCO_3$ | 0 | (25.61) | 0 | (7.78) | 0 | (6.07) | 0 | (34.65) | × |
| | $NaNO_3$ | 0 | (0.11) | 0 | (0.37) | 0 | (42.10) | 0 | (56.87) | |
| 5 | NaOH | 0 | (25.32) | 0 | (7.70) | 0 | (6.00) | 0 | (34.25) | × |
| | $NaNO_3$ | 0 | (0.114) | 0 | (0.373) | 0 | (42.06) | 0 | (56.86) | |
| 6 | borax | 0 | (25.27) | 0 | (7.68) | 0 | (5.98) | 0 | (34.19) | × |
| | $NaNO_3$ | 0 | (0.11) | 0 | (0.37) | 0 | (42.22) | 0 | (57.06) | |
| 7 | MgO | 0 | (26.33) | 0 | (8.0) | 0 | (6.24) | 0 | (35.62) | |

| | | MnO | | $Cr_2O_3$ | | $V_2O_5$ | | $Al_2O_3$ | | $SiO_2$ | |
|---|---|---|---|---|---|---|---|---|---|---|---|
| | $NaNO_3$ | 79.4 | (0.41) | 80.7 | (0.003) | 86.5 | (0.02) | 89.4 | (0.1) | 100 | (0) |
| 8 | CaO | 87.6 | (0.14) | 85.9 | (0.003) | 79.8 | (0.11) | 78.3 | (2.53) | 18.4 | (21.05) |
| | $NaNO_3$ | 85.9 | (0.28) | 86.4 | (0.002) | 78.6 | (0.03) | 86.7 | (0.12) | 94.6 | (0.09) |
| 9 | $Mg(OH)_2$ | 78.6 | (0.15) | 94.6 | (0.001) | 85.4 | (0.09) | 69.8 | (3.54) | 19.5 | (20.66) |
| | $NaNO_3$ | 79.4 | (0.41) | 96.4 | (0.0006) | 77.3 | (0.03) | 86.4 | (0.12) | 90.7 | (0.16) |
| 10 | $Ca(OH)_2$ | 84.6 | (0.17) | 97.5 | (0.0006) | 68.6 | (0.18) | 70.5 | (3.50) | 15.6 | (21.45) |
| | $NaNO_3$ | 87.6 | (0.24) | 96.4 | (0.0006) | 94.5 | (0.008) | 98.3 | (0.02) | 100 | (0) |
| 11 | $MgCO_3$ | 100 | (0) | 98.4 | (0.0003) | 96.3 | (0.02) | 68.6 | (3.64) | 17.8 | (21.04) |
| | $NaNO_3$ | 84.7 | (0.31) | 87.9 | (0.002) | 82.6 | (0.02) | 79.4 | (0.19) | 86.5 | (0.22) |
| 12 | $MgNO_3$ | 87.6 | (0.13) | 95.4 | (0.001) | 78.6 | (0.124) | 70.3 | (3.49) | 10.3 | (22.47) |

Shape of

Table 6-continued

| | | CaO | | MgO | | FeO | | $TiO_2$ | | Fluxing Reaction Product |
|---|---|---|---|---|---|---|---|---|---|---|
| | $NaNO_3$ | 0 | (0.11) | 0 | (0.37) | 0 | (42.08) | 0 | (56.89) | |
| 8 | CaO | 0 | (26.32) | 0 | (8.00) | 0 | (6.24) | 0 | (35.61) | ⊙ |
| | $NaNO_3$ | 0 | (0.11) | 0 | (0.37) | 0 | (42.09) | 0 | (56.89) | |
| 9 | $Mg(OH)_2$ | 0 | (26.19) | 0 | (7.93) | 0 | (6.19) | 0 | (35.32) | ⊙ |
| | $NaNO_3$ | 0 | (0.11) | 0 | (0.37) | 0 | (42.00) | 0 | (56.78) | |
| 10 | $Ca(OH)_2$ | 0 | (25.82) | 0 | (7.85) | 0 | (6.12) | 0 | (34.92) | ⊙ |
| | $NaNO_3$ | 0 | (0.11) | 0 | (0.37) | 0 | (42.19) | 0 | (57.04) | |
| 11 | $MgCO_3$ | 0 | (26.02) | 0 | (7.91) | 0 | (6.17) | 0 | (35.20) | ○ |
| | $NaNO_3$ | 0 | (0.114) | 0 | (0.37) | 0 | (42.25) | 0 | (57.11) | |
| 12 | $MgNO_3$ | 0 | (125.49) | 0 | (7.74) | 0 | (6.04) | 0 | (34.5) | Δ |

Notes:

1. Parenthesized values denote the composition of the residue (G).
2. In each item, the value of the upper line denotes a value obtained with respect to the case where ilmenite was used as the raw material and the value of the lower line denotes a value obtained with respect to the case where sand iron slag was used as the raw material.

What we claim is:

1. In a method of treating a titanium containing raw material selected from the group consisting of ilmenite, sand iron slag and high titanium slag by heat-treating the raw material in the presence of a flux composed mainly of an alkali metal nitrate or a thermal decomposition product thereof in an amount 2 to 5 times by weight of the amount of raw material in a non-reducing atmosphere to thereby effect a fluxing reaction, and subjecting the resulting fluxing reaction product to a leaching treatment of at least one stage in an aqueous medium to separate the fluxing reaction product into a leaching solution containing at least one metal component selected from the group consisting of Mn, V and Cr and a leaching residue composed of a concentrate of titanium component which is acid-soluble and substantially free of the metal component, the improvement which comprises incorporating said leaching residue in an amount at least 1.2 times by weight the amount of said raw material into the mixture of said raw material and said flux, shaping the resulting composition into granules, and heat-treating said granules at a temperature of 750° to 950° C for a time within the range of 3 minutes to 2 hours thereby keeping said granules in the substantially non-sticky state throughout the heat treatment.

2. A treatment method according to claim 1 wherein the fluxing reaction product is subjected to a leaching treatment using cold water maintained at 4° to 30° C. to dissolve out the manganese component in the fluxing reaction product into said cold water, and the leaching residue is subjected to a leaching treatment using an aqueous medium having a pH of 3 to 13 to dissolve out the vanadium and chromium components in the fluxing reaction product into said aqueous medium.

3. A treatment method according to claim 1 wherein said flux to be incorporated into said raw material has such a particle size distribution that particles having a particle size of 0.1 to 2 mm occupy at least 70% of the total particles.

4. A treatment method according to claim 1 wherein the leaching residue to be incorporated into said raw material has an oil absorption of at least 40 cc/100 g and an average particle size not larger than 89 μ.

5. A treatment method according to claim 1 wherein the leaching residue is incorporated into said raw material in an amount 1.3 to 1.7 times the amount of the raw material on the weight basis.

6. A treatment method according to claim 1 wherein in granulating the composition comprising said raw material, said flux and said leaching residue, a liquid granulation medium is used in an amount 0.05 to 0.5 time the amount of the raw material on the weight basis.

7. A treatment method according to claim 6 wherein the liquid granulation medium is water and it is used in an amount up to 0.2 time the amount of the raw material on the weight basis.

8. A treatment method according to claim 1 wherein the granular composition has a particle size of 0.2 to 20 mm.

9. A treatment method according to claim 1 wherein the fluxing heat treatment is conducted in a calcination furnace of the moving bed type in a continuous manner while keeping the granular composition in the non-sticky granular state.

* * * * *